US010712055B2

(12) United States Patent
Kim et al.

(10) Patent No.: US 10,712,055 B2
(45) Date of Patent: Jul. 14, 2020

(54) AIR CONDITIONER

(71) Applicant: SAMSUNG ELECTRONICS CO., LTD., Suwon-si, Gyeonggi-do (KR)

(72) Inventors: Kyoung-Rock Kim, Suwon-si (KR); Joon-Ho Yoon, Suwon-si (KR); Kwon Jin Kim, Suwon-si (KR); Dong-Gyu Lee, Suwon-si (KR); Eom Ji Jang, Anyang-si (KR); Dong Sik Jin, Hwaseong-si (KR); Seung Kwan Choi, Yongin-si (KR); Heung Seob Choi, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 77 days.

(21) Appl. No.: 16/001,342

(22) Filed: Jun. 6, 2018

(65) Prior Publication Data

US 2019/0063792 A1 Feb. 28, 2019

(30) Foreign Application Priority Data

Aug. 31, 2017 (KR) ..... 10-2017-0111486

(51) Int. Cl.
*F25B 13/00* (2006.01)
*F25B 49/02* (2006.01)
(Continued)

(52) U.S. Cl.
CPC ..... *F25B 13/00* (2013.01); *F24F 11/67* (2018.01); *F25B 49/02* (2013.01); *F24F 1/0003* (2013.01);
(Continued)

(58) Field of Classification Search
CPC ..... F25B 13/00; F25B 2313/007; F25B 2313/0231; F25B 2313/0232; F25B 2313/02741; F25B 2313/0315
See application file for complete search history.

(56) References Cited

U.S. PATENT DOCUMENTS

2004/0035132 A1 2/2004 Park et al.
2016/0131402 A1* 5/2016 Kim ..... F25B 30/02 62/324.6

FOREIGN PATENT DOCUMENTS

EP 1645810 4/2006
EP 1655553 5/2006
(Continued)

OTHER PUBLICATIONS

Extended European Search Report dated Jan. 24, 2019 in European Patent Application No. 18179843.0.
(Continued)

*Primary Examiner* — Marc E Norman
(74) *Attorney, Agent, or Firm* — Staas & Halsey LLP

(57) ABSTRACT

Disclosed herein is an air conditioner. The air conditioner includes an outdoor unit having a compressor, an outdoor heat exchanger, and a flowpath switching valve disposed on a refrigerant flowpath between the compressor and the outdoor heat exchanger, a plurality of indoor units configured to operate in a cooling mode or in a heating mode, a mode controller configured to selectively guide refrigerant received from the outdoor unit to the plurality of indoor units. The mode controller guiding the refrigerant through one or more of: a first refrigerant pipe extending from the flowpath switching valve to the mode control unit, a second refrigerant pipe extending from the flowpath switching valve and diverging to the outdoor heat exchanger, and to the
(Continued)

mode control unit, and a third refrigerant pipe extending from the outdoor heat exchanger to the mode controller.

19 Claims, 17 Drawing Sheets

(51) Int. Cl.
*F24F 11/67* (2018.01)
*F24F 1/0003* (2019.01)

(52) U.S. Cl.
CPC ..... *F24F 2221/54* (2013.01); *F25B 2313/007* (2013.01); *F25B 2313/0231* (2013.01); *F25B 2313/0233* (2013.01); *F25B 2313/02741* (2013.01); *F25B 2313/0315* (2013.01); *F25B 2400/04* (2013.01); *F25B 2600/2501* (2013.01)

(56) References Cited

FOREIGN PATENT DOCUMENTS

| | | |
|---|---|---|
| EP | 2549203 | 1/2013 |
| JP | 2012-47409 | 3/2012 |
| KR | 10-2008-0025599 | 3/2008 |
| KR | 10-2010-0036788 | 4/2010 |

OTHER PUBLICATIONS

European Communication dated Sep. 13, 2019 in European Patent Application No. 18179843.0.
Chinese Office Action dated Apr. 22, 2020 in Chinese Patent Application No. 201810768678.2.

* cited by examiner

AIR CONDITIONER

CROSS-REFERENCE TO RELATED APPLICATION

This application is based on and claims priority under 35 U.S.C. § 119 to Korean Patent Application No. 10-2017-0111486, filed on Aug. 31, 2017, in the Korean Intellectual Property Office, the disclosures of which are incorporated by reference herein in its entirety.

BACKGROUND

1. Field

The present disclosure relates to an air conditioner, and more particularly, to an air conditioner having an improved structure.

2. Description of the Related Art

Generally, in an air conditioner including a plurality of indoor units, the indoor units operate in the same operation mode, and users cannot adjust the operation mode of the indoor units individually although the indoor units are located in different spaces. In order to overcome the problem, manufacturers have developed an air conditioner having a heat recovery cycle allowing simultaneous cooling and heating, instead of a heat pump cycle, so that a plurality of indoor units can operate in different operation modes.

However, since an outdoor unit for a heat recovery cycle was manufactured separately from an outdoor unit for a heat pump cycle, the manufacturers had the burden of developing the two kinds of models separately, and sellers also had to possess the two kinds of models.

For this reason, an outdoor unit capable of performing both the heat recovery cycle and the heat pump cycle has been developed. The outdoor unit capable of performing both the heat recovery cycle and the heat pump cycle accommodates components for performing the heat recovery cycle therein. However, when the inside space of the outdoor unit is insufficient, there were limitations in disposing the components for performing the heat recovery cycle.

SUMMARY

Therefore, it is an aspect of the present disclosure to provide an air conditioner having an outdoor unit capable of performing both a heat pump cycle and a heat recovery cycle.

It is another aspect of the present disclosure to provide an air conditioner capable of reducing a size of an outdoor unit.

It is another aspect of the present disclosure to provide an air conditioner capable of performing both a heat pump cycle and a heat recovery cycle with a relatively simple configuration.

It is another aspect of the present disclosure to provide an air conditioner capable of reducing loss of refrigerant during cooling.

Additional aspects of the disclosure will be set forth in part in the description which follows and, in part, will be obvious from the description, or may be learned by practice of the disclosure.

In accordance with an aspect of the present disclosure, an air conditioner include an outdoor unit having a compressor, an outdoor heat exchanger, and a flowpath switching valve disposed on a refrigerant flowpath between the compressor and the outdoor heat exchanger, a plurality of indoor units configured to operate in a cooling mode or in a heating mode, a mode controller configured to selectively guide refrigerant received from the outdoor unit to the plurality of indoor units through one or more of: a first refrigerant pipe extending from the flowpath switching valve to the mode controller, a second refrigerant pipe extending from the flowpath switching valve and diverging to the outdoor heat exchanger and to the mode controller, and a third refrigerant pipe extending from the outdoor heat exchanger to the mode controller.

The mode controller may include a bypass flowpath connecting the second refrigerant pipe to the third refrigerant pipe, and a bypass valve configured to open or close the bypath flowpath.

While all of the plurality of indoor units operate in the cooling mode, the bypass valve may open the bypass flowpath so that the second refrigerant pipe communicates with the third refrigerant pipe.

The mode controller may further include a controller configured to control the bypass valve, and the controller may control the bypass valve to open the bypass flowpath, when a degree of supercooling of refrigerant flowing through the third refrigerant pipe is smaller than or equal to a predetermined degree of supercooling based on a discharge pressure of the compressor.

The outdoor unit may further include a temperature sensor disposed at a portion of the third refrigerant pipe that is disposed in an inside of the outdoor unit.

The mode controller may further include a controller configured to control the bypass valve, and wherein the controller may control the bypass valve to open the bypass flowpath, when a degree of supercooling of refrigerant passed through the outdoor heat exchanger is smaller than or equal to a predetermined degree of supercooling based on discharge pressure of the compressor.

The outdoor unit may further include a temperature sensor disposed at a portion of the outdoor heat exchanger adjacent to the third refrigerant pipe.

The mode controller may be disposed in an indoor space.

The mode controller may include a heating valve configured to open or close the refrigerant flowpath to transfer refrigerant to indoor units operating in the heating mode among the plurality of indoor units, a cooling valve configured to open or close the refrigerant flowpath to receive refrigerant from indoor units operating in the cooling mode among the plurality of indoor units, a main cooling valve disposed on the refrigerant flowpath between the heating valve and the second refrigerant pipe, and a main heating valve disposed on the refrigerant flowpath between the cooling valve and the second refrigerant pipe.

When indoor units among the plurality of indoor units operate in the heating mode, and a number of indoor units operating in the cooling mode among the plurality of indoor units are more than a number of the indoor units operating in the heating mode, the main cooling valve may open the refrigerant flowpath so that the heating valve communicates with the second refrigerant pipe.

When indoor units among the plurality of indoor units operate in the cooling mode, and a number of indoor units operating in the heating mode among the plurality of indoor units are more than a number of the indoor units operating in the cooling mode, the main heating valve may open the refrigerant flowpath so that the cooling valve communicates with the second refrigerant pipe.

The outdoor unit may include an accumulator connected to the compressor, and a circulating pipe connecting the flowpath switching valve, the accumulator, and the compressor, sequentially.

The mode controller may include a switching flowpath connecting the first refrigerant pipe to the second refrigerant pipe, and a switching valve configured to open or close the switching flowpath.

The switching valve may open or close the switching flowpath to adjust a difference between pressure of refrigerant flowing through the first refrigerant pipe and pressure of refrigerant flowing through the second refrigerant pipe.

The flowpath switching valve may be a 4-way valve.

In accordance with an aspect of an example embodiment, an air conditioner includes an outdoor unit having a compressor, an outdoor heat exchanger, and a flowpath switching valve disposed on a refrigerant flowpath between the compressor and the outdoor heat exchanger, a plurality of indoor units configured to operate in a cooling mode or in a heating mode, a mode controller configured to selective guide refrigerant received from the outdoor unit to the plurality of indoor units through one or more of: a first refrigerant pipe extending from the flowpath switching valve to the mode controller, a second refrigerant pipe extending from the flowpath switching valve and diverging to the outdoor heat exchanger, and the mode controller, and a third refrigerant pipe extending from the outdoor heat exchanger to the mode controller, wherein while the plurality of indoor units operate in the cooling mode, the mode controller guides refrigerant entering the second refrigerant pipe to the third refrigerant pipe.

The outdoor unit may further include a temperature sensor disposed at a portion of the third refrigerant pipe disposed in an inside of the outdoor unit, and wherein the mode controller may guide refrigerant entered the second refrigerant pipe to the third refrigerant pipe, when a degree of supercooling of refrigerant flowing through the third refrigerant pipe is smaller than or equal to a predetermined degree of supercooling based on temperature measured by the temperature sensor.

The outdoor unit may further include a temperature sensor disposed at a portion of the outdoor heat exchanger adjacent to the third refrigerant pipe, and wherein the mode controller may guide refrigerant entered the second refrigerant pipe to the third refrigerant pipe, when a degree of supercooling of refrigerant passed through the outdoor heat exchanger is smaller than or equal to a predetermined degree of supercooling based on temperature measured by the temperature sensor.

The mode controller may be disposed in an indoor space.

In accordance with an aspect of an example embodiment, an air conditioner includes an outdoor unit having a compressor, an outdoor heat exchanger, and a flowpath switching valve disposed on a refrigerant flowpath between the compressor and the outdoor heat exchanger, a plurality of indoor units configured to operate in a cooling mode or in a heating mode, a mode controller configured to selectively guide refrigerant received from the outdoor unit to the plurality of indoor units through one or more of: a first refrigerant pipe extending from the flowpath switching valve to the mode controller, a second refrigerant pipe extending from the flowpath switching valve and diverging to the outdoor heat exchanger, and the mode controller, and a third refrigerant pipe extending from the outdoor heat exchanger to the mode controller, wherein the mode controller includes a first check valve configured to enable the first refrigerant pipe to communicate with the plurality of indoor units, while the plurality of indoor units operate in the cooling mode, a second check valve configured to enable the first refrigerant pipe to communicate with the plurality of indoor units, while the plurality of indoor units operate in the heating mode, a third check valve configured to enable the second refrigerant pipe to communicate with indoor units operating in the heating mode among the plurality of indoor units, while a number of indoor units operating in the cooling mode among the plurality of indoor units are more than a number of the indoor units operating in the heating mode, and a fourth check valve configured to enable the second refrigerant pipe to communicate with indoor units operating in the cooling mode among the plurality of indoor units, while the number of indoor units operating in the heating mode among the plurality of indoor units are more than the number of the indoor units operating in the cooling mode.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
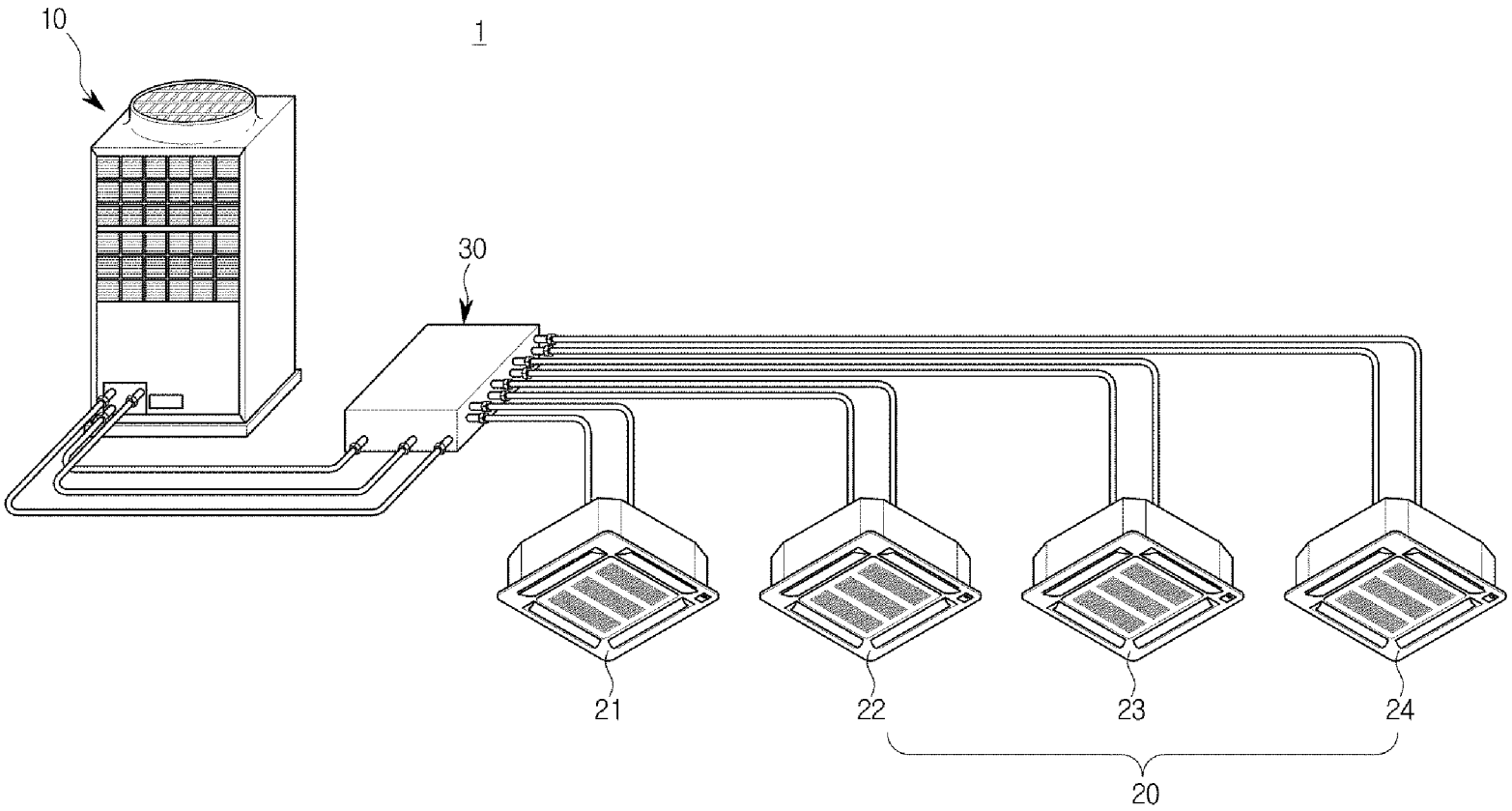
FIG. 1 shows an air conditioner according to an embodiment of the present disclosure.

Configurations illustrated in the embodiments and the drawings described in the present specification are only the preferred embodiments of the present disclosure, and thus it is to be understood that various modified examples, which may replace the embodiments and the drawings described in the present specification, are possible when filing the present application.

Also, like reference numerals or symbols denoted in the drawings of the present specification represent members or components that perform the substantially same functions.

The terms used in the present specification are used to describe the embodiments of the present disclosure. Accordingly, it should be apparent to those skilled in the art that the following description of exemplary embodiments of the present disclosure is provided for illustration purpose only and not for the purpose of limiting the disclosure as defined by the appended claims and their equivalents. It is to be understood that the singular forms "a," "an," and "the" include plural referents unless the context clearly dictates otherwise. It will be understood that when the terms "includes," "comprises," "including," and/or "comprising," when used in this specification, specify the presence of stated features, figures, steps, components, or combination thereof, but do not preclude the presence or addition of one or more other features, figures, steps, components, members, or combinations thereof.

As used herein, the term "and/or" includes any and all combinations of one or more of associated listed items.

A cooling cycle constituting an air conditioner may be configured with a compressor, a condenser, an expansion valve, and an evaporator. The cooling cycle may perform a series of processes of compression-condensation-expansion-evaporation so as to heat-exchange air with refrigerants and then supply air-conditioned air.

The compressor may compress refrigerant gas to a high-temperature, high-pressure state, and discharge the compressed refrigerant gas to the condenser. The condenser may condense the compressed refrigerant gas to a liquid state, and emit heat to the surroundings during the condensing process.

The expansion valve may expand the liquid-state refrigerants in the high-temperature, high-pressure state condensed by the condenser to liquid-state refrigerants in a low-pressure state. The evaporator may evaporate the refrigerants expanded by the expansion valve, and return the refrigerant gas in the low-temperature, low-pressure state to the compressor. The evaporator may achieve a cooling effect through heat-exchange with an object to be cooled using evaporative latent heat of refrigerants. Through the cycle, the air conditioner can adjust the temperature of indoor space.

An outdoor unit of the air conditioner may be a part of the cooling cycle, configured with the compressor and an outdoor heat exchanger. An indoor unit of the air conditioner may include an indoor heat exchanger, and the expansion valve may be installed in any one of the indoor unit and the outdoor unit. The indoor heat exchanger and the outdoor heat exchanger may function as a condenser or an evaporator. When the indoor heat exchanger is used as a condenser, the air conditioner may function as a heater, and when the indoor heat exchanger is used as an evaporator, the air conditioner may function as a cooler.

Hereinafter, a case in which indoor units operating in a cooling mode among a plurality of indoor units are more than indoor units operating in a heating mode will be referred to as a main cooling mode, and a case in which indoor units operating in a heating mode among a plurality of indoor units are more than indoor units operating in a cooling mode will be referred to as a main heating mode.

Hereinafter, the embodiments of the present disclosure will be described in detail with reference to the accompanying drawings.

Figure 2:
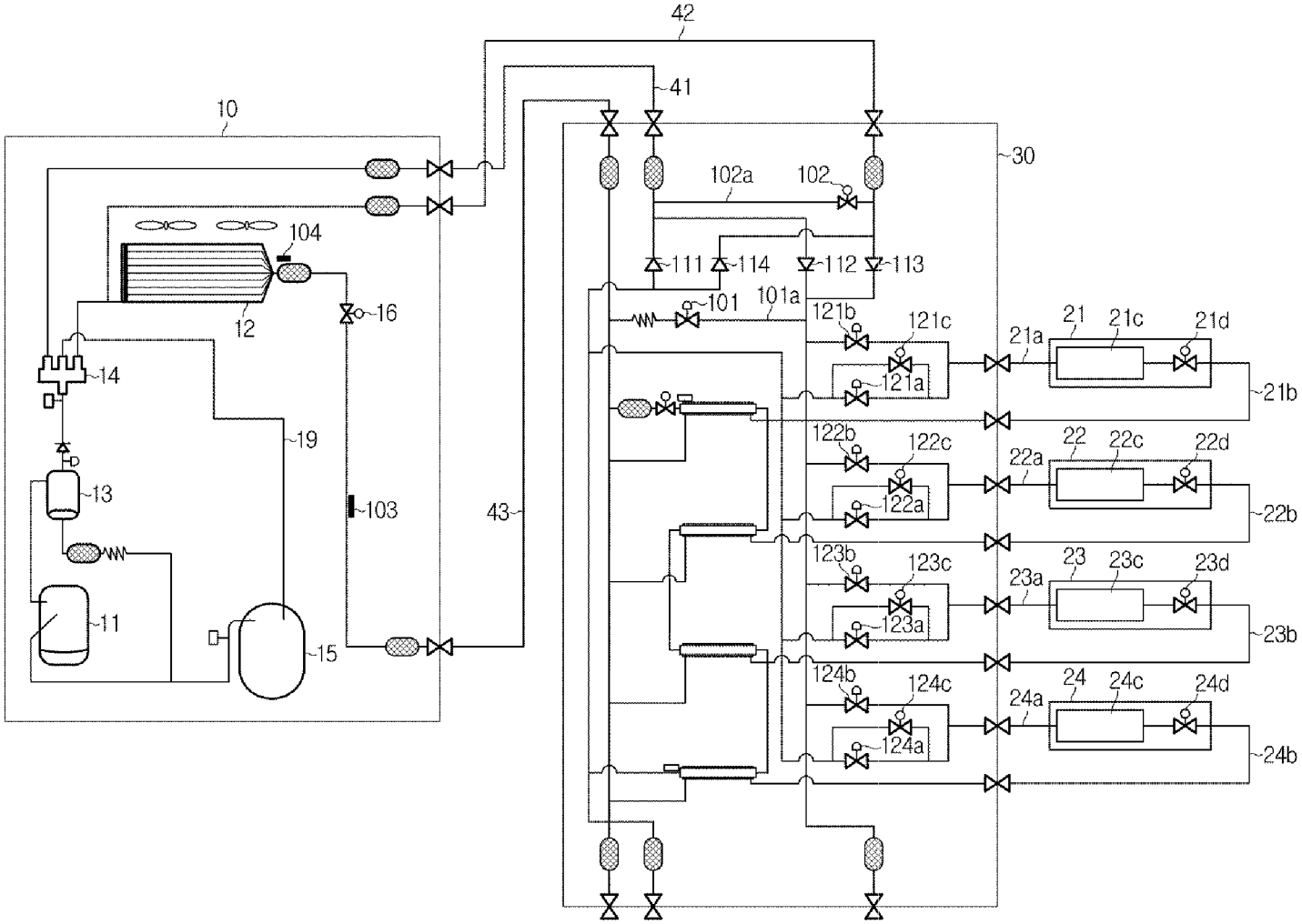
FIG. 2 shows a cooling cycle of the air conditioner shown in FIG. 1.

FIG. 1 shows an air conditioner according to an embodiment of the present disclosure. FIG. 2 shows a cooling cycle of the air conditioner shown in FIG. 1.

Referring to FIGS. 1 and 2, an air conditioner 1 according to an embodiment of the present disclosure may include at least one outdoor unit 10, a plurality of indoor units 20, and a mode control unit 30. The at least one outdoor unit 10, the plurality of indoor units 20, and the mode control unit 30 of the air conditioner 1 may be connected to each other through a plurality of pipes through which refrigerants can move.

The outdoor unit 10 may be provided as a single unit or a plurality of units. In FIG. 1, for convenience of description, the outdoor unit 10 may be provided as a single unit. However, a plurality of outdoor units 10 may be provided, unlike FIG. 1. The outdoor unit 10 may perform both a heat pump cycle and a heat recovery cycle.

The outdoor unit 10 may include a compressor 11 and an outdoor heat exchanger 12.

The compressor 11 may be installed in the inside of the outdoor unit 10. The compressor 11 may compress refrigerants to a high-pressure state. The compressor 11 may compress refrigerants to a high-pressure gaseous state. The high-pressure refrigerant gas compressed by the compressor 11 may move to at least one of the outdoor heat exchanger 12 and the mode control unit 30 along the plurality of pipes.

The outdoor heat exchanger 12 may be installed in the inside of the outdoor unit 10. The outdoor heat exchanger 12 may be disposed between a flowpath switching valve 14 and the mode control unit 30.

The outdoor heat exchanger 12 may operate as an evaporator that vaporizes refrigerants in a liquid state according to an operation mode of the air conditioner 1. More specifically, the outdoor heat exchanger 12 may function as an evaporator when the indoor units 20 operate in a heating mode.

Also, the outdoor heat exchanger 12 may operate as a condenser that liquefies refrigerants in a gaseous state according to an operation mode of the air conditioner 1. More specifically, the outdoor heat exchanger 12 may function as a condenser when the indoor units 20 operate in a cooling mode.

The outdoor unit 10 may include an oil separator 13, the flowpath switching valve 14, an accumulator 15, and an outdoor expansion valve 16.

The oil separator 13 may filter oil included in high-pressure, high-temperature refrigerants discharged from the compressor 11, and then again return the oil to the compressor 11. Herein, the oil may be used to smoothly drive the compressor 11. Also, if a plurality of compressors 11 are provided, a plurality of oil separators 13 may be provided to correspond to the plurality of compressors 11. The oil separator 13 may be connected to the compressor 11 through a pipe.

The flowpath switching valve 14 may be disposed on a refrigerant flowpath between the compressor 11 and the outdoor heat exchanger 12. The flowpath switching valve 14 may be connected to the oil separator 13. The flowpath switching valve 14 may move refrigerants in a high-pressure gaseous state compressed by the compressor 11 to the indoor heat exchanger 12 and/or the mode control unit 30 according to an operation mode of the indoor units 20. The flowpath switching valve 14 may be a 4-way valve. The flowpath switching valve 14 may be connected to the accumulator 15.

The accumulator 15 may be disposed between the compressor 11 and the flowpath switching valve 14. The accumulator 15 may be connected to the compressor 11 and the flowpath switching valve 14 through a circulating pipe 19.

The accumulator 15 may separate low-pressure, low-temperature refrigerants passed through the flowpath switching valve 14 to gaseous refrigerants and liquid refrigerants. More specifically, when the refrigerants entered the compressor 11 include liquid refrigerants, the compressor 11 may be damaged. Therefore, the accumulator 15 may separate the refrigerants to gaseous refrigerants and liquid refrigerants, and then transfer the gaseous refrigerants to the compressor 11. Accordingly, the liquid refrigerants cannot enter the compressor 11, and only the gaseous refrigerants can enter the compressor 11. A capacity of the accumulator 15 may correspond to an amount of refrigerants flowing in the air conditioner 1.

The outdoor expansion valve 16 may be disposed between the outdoor heat exchanger 12 and the mode control unit 30 in the inside of the outdoor unit 10. The outdoor expansion valve 16 may convert high-pressure refrigerants moving from the mode control unit 30 to the outdoor heat exchanger 12 to a low-pressure state.

The outdoor unit 10 may include a first temperature sensor 103 for measuring temperature of a third refrigerant pipe 43. The first temperature sensor 103 may be disposed on a portion of the third refrigerants pipe 43 disposed in the inside of the outdoor unit 10. The first temperature sensor 103 may measure temperature of the third refrigerant pipe 43 to thereby measure temperature of the refrigerants flowing through the third refrigerant pipe 43.

Figure 7:
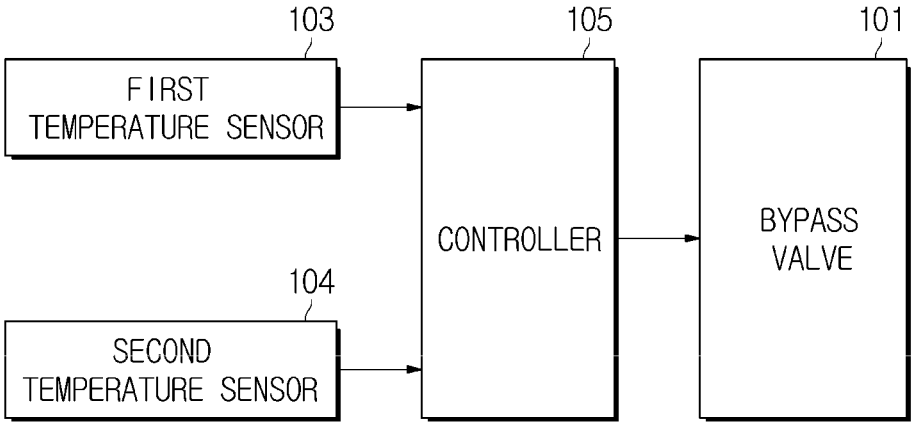
FIG. 7 is a control block diagram showing components for controlling a bypass valve shown in FIG. 2.

The first temperature sensor 103 may be connected to a controller 105 (see FIG. 7). The first temperature sensor 103 may transfer information about measured temperature of the third refrigerant pipe 43 to the controller 105. The controller 105 may control a bypass valve 101 based on the information about temperature. This operation will be described in detail, later.

The outdoor unit 10 may include a second temperature sensor 104 for measuring temperature of the outdoor heat exchanger 12. The second temperature sensor 104 may be disposed at a portion of the outdoor heat exchanger 12 adjacent to the third refrigerants pipe 43. The second temperature sensor 104 may be disposed at a connection point at which the outdoor heat exchanger 12 is connected to the third refrigerant pipe 43. Accordingly, the second temperature sensor 104 may measure temperature of the refrigerants heat-exchanged by passing through the outdoor heat exchanger 12.

The second temperature sensor 104 may be connected to the controller 105. The second temperature sensor 104 may transfer information about measured temperature of the outdoor heat exchanger 12 to the controller 105. The controller 105 may control the bypass valve 101 based on the received information about temperature. This operation will be described in detail, later.

The plurality of indoor units 20 may be provided as described above. In FIG. 1, for convenience of description, a first indoor unit 21, a second indoor unit 22, a third indoor unit 23, and a fourth indoor unit 24 are shown. However, the number of the indoor units 20 may be five or more.

The plurality of indoor units 20 may operate in the cooling mode or in the heating mode. All of the plurality of indoor units 20 may operate in the cooling mode or in the heating mode. Also, a part of the plurality of indoor units 20 may operate in the cooling mode, and the remaining part of the plurality of indoor units 20 may operate in the heating mode.

In order to operate the plurality of indoor units 20 in the cooling mode or in the heating mode, the plurality of indoor units 20 may be connected to the mode control unit 30. More specifically, the first indoor unit 21 may be connected to the mode control unit 30 through first indoor unit connecting pipes 21*a* and 21*b*, the second indoor unit 22 may be connected to the mode control unit 30 through second indoor unit connecting pipes 22*a* and 22*b*, the third indoor unit 23 may be connected to the mode control unit 30 through third indoor unit connecting pipes 23*a* and 23*b*, and the fourth indoor unit 24 may be connected to the mode control unit 30 through fourth indoor unit connecting pipes 24*a* and 24*b*.

The plurality of indoor units 20 may include a plurality of indoor heat exchangers 21*c*, 22*c*, 23*c*, and 24*c* and a plurality of indoor expansion valves 21*d*, 22*d*, 23*d*, and 24*d*. The plurality of indoor heat exchangers 21*c*, 22*c*, 23*c*, and 24*c* may operate as condensers or evaporators according to modes of the plurality of indoor heat exchangers 21, 22, 23, and 24. More specifically, the plurality of indoor heat exchangers 21*c*, 22*c*, 23*c*, and 24*c* may function as condensers when the plurality of indoor units 21, 22, 23, and 24 operate in the heating mode. Also, the plurality of indoor heat exchangers 21*c*, 22*c*, 23*c*, and 24*c* may function as evaporators when the plurality of indoor units 21, 22, 23, and 24 operate in the cooling mode.

The mode control unit 30 may be disposed between the indoor unit 10 and the indoor units 20. The mode control unit 30 may move high-pressure gaseous refrigerants and/or liquefied refrigerants moved from the outdoor unit 10 to the individual indoor units 20 according to operation modes of the indoor units 20. Also, the mode control unit 30 may move low-pressure gaseous refrigerants and/or liquefied refrigerants moved from the plurality of indoor units 20 to the outdoor unit 10.

The mode control unit 30 may be connected to the outdoor unit 10 through a first refrigerant pipe 41, a second refrigerant pipe 42, and the third refrigerant pipe 43. The mode control unit 30 may be connected to the first refrigerant pipe 41, the second refrigerant pipe 42, and the third refrigerant pipe 43 to move refrigerants.

The mode control unit 30 may be connected to the plurality of indoor units 21, 22, 23, and 24 through the first indoor unit connecting pipes 21*a* and 21*b*, the second indoor unit connecting pipes 22*a* and 22*b*, the third indoor unit connecting pipes 23*a* and 23*b*, and the fourth indoor unit connecting pipes 24*a* and 24*b*. The mode control unit 30 may be connected to the plurality of indoor units 21, 22, 23, and 24 through the first indoor unit connecting pipes 21*a* and 21*b*, the second indoor unit connecting pipes 22*a* and 22*b*, the third indoor unit connecting pipes 23*a* and 23*b*, and the fourth indoor unit connecting pipes 24*a* and 24*b* to move refrigerants.

The first refrigerant pipe 41 may connect the outdoor unit 10 to the mode control unit 30. The first refrigerant pipe 41 may extend from the flowpath switching valve 14 of the outdoor unit 10 to the mode control unit 30.

The second refrigerant pipe 42 may connect the outdoor unit 10 to the mode control unit 30. The second refrigerant pipe 42 may diverge between the flowpath switching valve 14 and the outdoor heat exchanger 12 to extend to the mode control unit 30.

The third refrigerant pipe 43 may connect the outdoor unit 10 to the mode control unit 30. The third refrigerant pipe 43 may extend from the outdoor heat exchanger 12 to the mode control unit 30.

The mode control unit 30 may include the bypass valve 101. The bypass valve 101 may open or close a bypass flowpath 101*a*. The bypass flowpath 101*a* may connect the second refrigerant pipe 42 to the third refrigerant pipe 43. When all of the plurality of indoor units 20 operate in the cooling mode, the bypass flowpath 101*a* may guide refrigerants liquefied when the refrigerants flow along the second refrigerant pipe 42 after diverging between the flowpath switching valve 14 and the outdoor heat exchanger 12, and then remaining in the second refrigerant pipe 42, to the third refrigerant pipe 43. That is, the bypass flowpath 101*a* may connect the second refrigerant pipe 42 to the third refrigerant pipe 43.

More specifically, when all of the plurality of indoor units 20 operate in the cooling mode, a part of refrigerants flowing from the flowpath switching valve 14 to the outdoor heat exchanger 12 may diverge to the second refrigerant pipe 42 to flow to the mode control unit 30. The mode control unit 30 may be located indoor. When all of the plurality of indoor units operate in the cooling mode, high-pressure, high-temperature refrigerants flowing along the second refrigerant pipe 42 may remain in the insides of the second refrigerant pipe 42 and the mode control unit 30, without being supplied to the plurality of indoor units 20. Since indoor space where the mode control unit 30 is disposed is at temperature that is lower than the temperature of the refrigerants, the refrigerants may remain and be liquefied so as not to circulate along the refrigerant flowpath.

The bypass flowpath 101*a* may guide the remaining refrigerants to the third refrigerant pipe 43. The bypass valve 101 may open the bypass flowpath 101*a* to guide the liquefied and remaining refrigerants to the third refrigerant pipe 43. In the air conditioner 1 according to the current embodiment, the bypass valve 101 may open the bypass flowpath 101*a* to move the liquefied and remaining refrigerants to the third refrigerant pipe 43 and thus return the refrigerants to the outdoor unit 10, thereby reducing loss of the refrigerants.

A method of controlling the bypass valve 101 will be described later.

The mode control unit 30 may include a mode switching valve 102. The mode switching valve 102 may open or close a mode switching flowpath 102*a*. The mode switching flowpath 102*a* may connect the first refrigerant pipe 41 to the second refrigerant pipe 42. The mode switching valve 102 may open or close the mode switching flowpath 102*a* to adjust a difference between pressure of refrigerants flowing through the first refrigerant pipe 41 and pressure of refrigerants flowing through the second refrigerant pipe 42.

The mode control unit 30 may include a first check valve 111, a second check valve 112, a third check valve 113, and a fourth check valve 114.

When all of the plurality of indoor units 20 operate in the cooling mode, the first check valve 111 may communicate the first refrigerant pipe 41 with the plurality of indoor units 20. More specifically, the first check valve 111 may move refrigerants heat-exchanged in the plurality of indoor units 20 to the outdoor unit 10.

When all of the plurality of indoor units 20 operate in the heating mode, the second check valve 112 may communicate the first refrigerant pipe 41 with the plurality of indoor units 20. More specifically, the second check valve 112 may move high-pressure refrigerants from the outdoor unit 10 to the plurality of indoor units 20.

When the indoor units 20 operating in the cooling mode among the plurality of indoor units 20 are more than the indoor units 20 operating in the heating mode, the third check valve 113 may communicate the second refrigerant pipe 42 with the indoor units 20 operating in the heating mode. More specifically, the third check valve 113 may move high-pressure refrigerants from the outdoor unit 10 to the indoor units 20 operating in the heating mode.

When the indoor units 20 operating in the heating mode among the plurality of indoor units 20 are more than the indoor units 20 operating in the cooling mode, the fourth check valve 114 may communicate the second refrigerant pipe 42 with the indoor units 20 operating in the cooling mode. More specifically, the fourth check valve 114 may move refrigerants heat-exchanged in the indoor units 20 operating in the cooling mode to the outdoor unit 10.

The mode control unit 30 may include a plurality of cooling valves 121*a*, 122*a*, 123*a*, and 124*a*, and a plurality of heating valves 121*b*, 122*b*, 123*b*, and 124*b*.

The plurality of cooling valves 121*a* 122*a*, 123*a*, and 124*a* may open or close the refrigerant flowpath to guide the refrigerants heat-exchanged in the indoor units 20 to the first refrigerant pipe 41 or the second refrigerant pipe 42, when the indoor units 20 operate in the cooling mode. The plurality of cooling valves 121*a* 122*a*, 123*a*, and 124*a* may open or close the refrigerant flowpath to receive refrigerants from the indoor units 20, when the indoor units 20 operate in the cooling mode.

The plurality of heating valves 121*b*, 122*b*, 123*b*, and 124*b* may open or close the refrigerant flowpath to guide the high-pressure refrigerants received from the outdoor unit 10 to the indoor units 20, when the indoor units 20 operate in the heating mode. The plurality of heating valves 121*b*, 122*b*, 123*b*, and 124*b* may open or close the refrigerant flowpath to transfer the refrigerants to the indoor units 20, when the indoor units 20 operate in the heating mode.

The mode control unit 30 may further include a plurality of cooling switching valves 121*c*, 122*c*, 123*c*, and 124*c*. The number of the plurality of cooling switching valves 121*c*, 122*c*, 123*c*, and 124*c* may correspond to the number of the plurality of cooling values 121*a*, 122*a*, 123*a*, and 124*a*. The plurality of cooling switching valves 121*c*, 122*c*, 123*c*, and 124*c* may reduce noise that may be generated in the refrigerant pipes, by bypassing a part of refrigerants heat-exchanged in the plurality of indoor units 20 when the refrigerants flow to the plurality of cooling valves 121*a*, 122*a*, 123*a*, and 124*a*.

As such, the air conditioner 1 according to an embodiment of the present disclosure may dispose components for a heat recovery cycle in the mode control unit 30, instead of the outdoor unit 10, thereby reducing the size of the outdoor unit 10.

Figure 3:
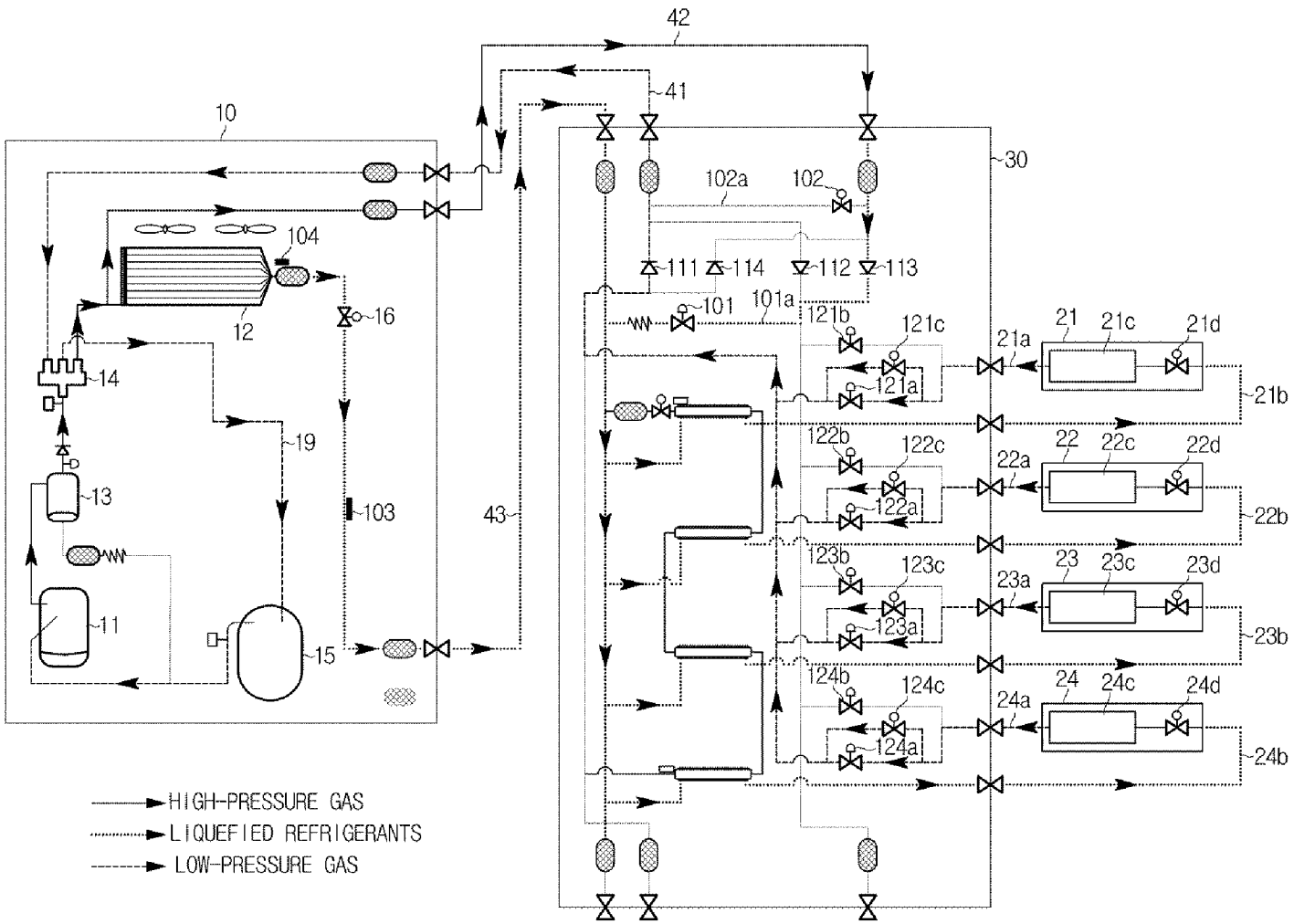
FIG. 3 shows circulation of refrigerants when all of a plurality of indoor units in the air conditioner shown in FIG. 2 are in a cooling mode.

FIG. 3 shows circulation of refrigerants when all of a plurality of indoor units in the air conditioner shown in FIG. 2 are in a cooling mode.

Referring to FIG. 3, when all of the plurality of indoor units 20 operate in the cooling mode, liquefied refrigerants and high-pressure gaseous refrigerants may move from the outdoor unit 10 to the mode control unit 30.

More specifically, refrigerants compressed to a high-pressure gaseous state by the compressor 11 may move from the flowpath switching valve 14 toward the outdoor heat exchanger 12. The refrigerants moved to the outdoor heat-exchanger 12 may be heat-exchanged by the outdoor heat exchanger 12, and then condensed to be liquefied. The condensed refrigerants may flow along the third refrigerant pipe 43 to move to the mode control unit 30.

The refrigerants moved to the mode control unit 30 may move to the plurality of indoor units 20. The liquefied refrigerants may move to the individual indoor units 21, 22, 23, and 24 along a 1b-th indoor unit connecting pipe 21*b*, a 2b-th indoor unit connecting pipe 22*b*, a 3b-th indoor unit connecting pipe 23*b*, and a 4b-th indoor unit connecting pipe 24*b*.

The refrigerants moved to the plurality of indoor units 20 may expand by the indoor expansion valves 21*d*, 22*d*, 23*d*, and 24*d*, and then vaporized by the indoor heat exchangers 21*c*, 22*c*, 23*c*, and 24*c* to become a low-pressure gaseous state.

The refrigerants in the low-pressure gaseous state may move to the mode control unit 30 along a 1a-th indoor unit connecting pipe 21*a*, a 2a-th indoor unit connecting pipe 22*a*, a 3a-th indoor unit connecting pipe 23*a*, and a 4a-th indoor unit connecting pipe 24*a*, pass through the cooling valves 121*a*, 122*a*, 123*a*, and 124*a* and the cooling switching valves 121*c* 122*c*, 123*c*, and 124*c* of the individual indoor units 20, and then move to the second cooling pipe 41 via the first check valve 111. The refrigerants in the low-pressure gaseous state may move to the flowpath switching valve 14 along the first cooling pipe 41, and then move to the accumulator 15 along the circulating pipe 19.

The refrigerants passed through the accumulator 15 may move to the compressor 11.

Meanwhile, a part of the refrigerants in the high-pressure gaseous state moving to the outdoor heat exchanger 12 may diverge to the second refrigerant pipe 42 to thus move to the mode control unit 30. If the bypass valve 101 is closed, and the refrigerants in the high-pressure gaseous state moved to the mode control unit 30 remain in the mode control unit 30, the refrigerants may be liquefied by the temperature of indoor space where the mode control unit 30 is disposed. The liquefied refrigerants cannot circulate in the refrigerant pipes, and accordingly, the air conditioner 1 may cause loss of the refrigerants.

In order to prevent the problem, the air conditioner 1 according to the current embodiment may cause the bypass valve 101 to open the bypass flowpath 101*a*, thereby guiding the liquefied refrigerants remaining in the mode control unit 30 to the third refrigerant pipe 43 along the bypass flowpath 101*a*. The refrigerants entered the third refrigerant pipe 43 may move to the plurality of indoor units 20, together with refrigerants entered through the outdoor heat exchanger 12.

According to the configuration, the air conditioner 1 according to the embodiment may guide the refrigerants remaining in the second refrigerant pipe 42 to the third refrigerant pipe 43 through the bypass flowpath 101*a* for a heat recovery cycle, thereby preventing loss of refrigerants.

Figure 4:
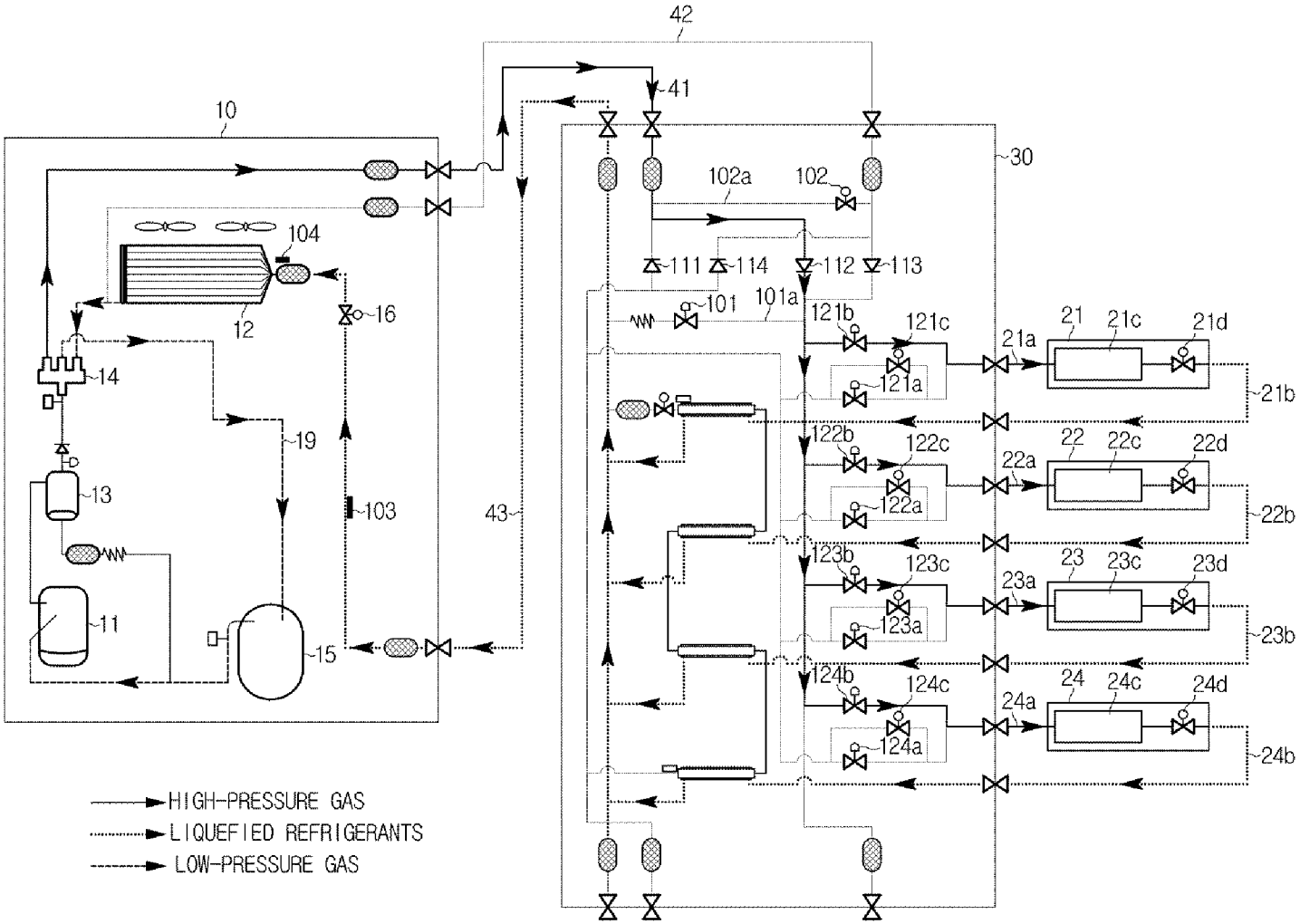
FIG. 4 shows circulation of refrigerants when all of the plurality of indoor units in the air conditioner shown in FIG. 2 are in a heating mode.

FIG. 4 shows circulation of refrigerants when all of the plurality of indoor units in the air conditioner shown in FIG. 2 are in a heating mode.

Referring to FIG. 4, when all of the plurality of indoor units operate in the heating mode, refrigerants in a high-pressure gaseous state may move from the outdoor unit 10 to the mode control unit 30.

More specifically, refrigerants compressed to a high-pressure gaseous state by the compressor 11 may move to the first refrigerant pipe 41 through the flowpath switching valve 14. Then, the refrigerants may move to the mode control unit 30 along the first refrigerant pipe 41.

The refrigerants moved to the mode control unit 30 may pass through the second check valve 112, and then pass through the heating valves 121*b*, 122*b*, 123*b*, and 124*b* and the 1a-th indoor unit connecting pipes 21*a*, 22*a*, 23*a*, and 24*a*, sequentially, to move to the indoor units 21, 22, 23, and 24.

The refrigerants moved to the indoor units 21, 22, 23, and 24 may be condensed by the indoor heat exchangers 21*c*, 22*c*, 23*c*, and 24*c* to become a liquefied state.

The refrigerants changed to the liquefied state may pass through the 1b-th indoor unit connecting pipe 21*b*, the 2b-th indoor unit connecting pipe 22*b*, the 3b-th indoor unit connecting pipe 23*b*, and the 4b-th indoor unit connecting pipe 24*b* to move to the third refrigerant pipe 43. The refrigerants may move along the third refrigerant pipe 43, expand in the outdoor expansion valve 16, and then vaporize in the outdoor heat exchanger 12.

The vaporized refrigerants in the low-pressure gaseous state may pass through the flowpath switching valve 14 and the circulating pipe 19 to move to the accumulator 15, and the refrigerants passed through the accumulator 15 may move to the compressor 11.

Figure 5:
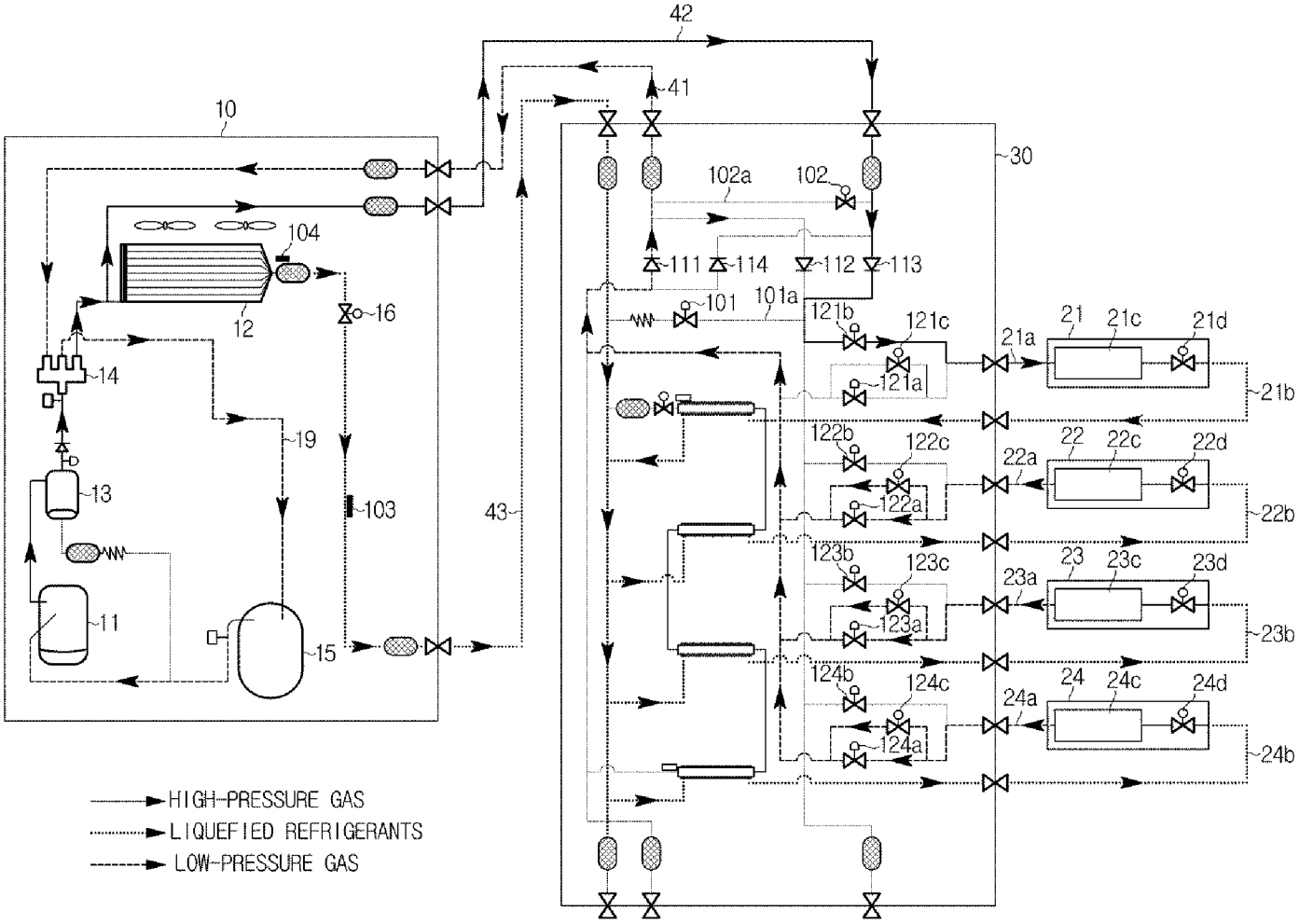
FIG. 5 shows circulation of refrigerants when all of the plurality of indoor units in the air conditioner shown in FIG. 2 are in a main cooling mode.

FIG. 5 shows circulation of refrigerants when all of the plurality of indoor units in the air conditioner shown in FIG. 2 are in a main cooling mode.

Referring to FIG. 5, when the plurality of indoor units 20 operate in the heating mode and the cooling mode, and the indoor units 20 operating in the cooling mode are more than the indoor units 20 operating in the heating mode, that is, when the plurality of indoor units 20 are in the main cooling mode, refrigerants in a high-pressure gaseous state and liquefied refrigerants may move from the outdoor unit 10 to the mode control unit 30.

A part of the refrigerants in the high-pressure gaseous state passed through the flowpath switching valve 14 may move to the outdoor heat exchanger 12, and the remaining part of the refrigerants may move to the mode control unit 30 along the second refrigerant pipe 42.

The refrigerants moved to the outdoor heat exchanger 12 may be condensed in the outdoor heat exchanger 12 to become a liquefied state. The refrigerants in the liquefied state may move to the second, third, and fourth indoor units 22, 23, and 24 along the 2b-th, 3b-th, and 4b-th indoor unit connecting pipes 22*b*, 23*b*, and 24*b* of the second, third, and fourth indoor units 22, 23, and 24 operating in the cooling mode.

The refrigerants entered the second, third, and fourth indoor units 22, 23, and 24 may expand in the second, third, and fourth indoor unit expansion valves 22*d*, 23*d*, and 24*d* and then vaporized in the second, third, and fourth indoor heat exchangers 22*c*, 23*c*, and 24*c* to become a low-pressure gaseous state.

The refrigerants in the low-pressure gaseous state may move to the mode control unit 30 along the 2a-th, 3a-th, and 4a-th indoor unit connecting pipes 22*a*, 23*a*, and 24*a*, and then pass through the cooling valves 122*a*, 123*a*, and 124*a* and the cooling switching valves 122*c*, 123*c*, and 124*c* to move to the first check valve 111. The refrigerants in the low-pressure gaseous state passed through the first check valve 111 may move to the flowpath switching valve 14 of the outdoor unit 10 along the first refrigerant pipe 41, and the refrigerants passed through the flowpath switching valve 14 may move to the compressor 11 through the circulating pipe 10 and the accumulator 15.

Meanwhile, the refrigerants in the high-pressure gaseous state diverging to the second refrigerant pipe 42 may pass through the third check valve 113, and then move to the indoor unit 21 operating in the heating mode.

More specifically, the refrigerants passed through the third check valve 113 may pass through the heating valve 121*b*, and then move to the first indoor unit 21 along the 1a-th indoor unit connecting pipe 21*a*. The refrigerants in the high-pressure gaseous state moved to the first indoor unit 21 may be condensed in the first indoor heat exchanger 21*c*, and then move to the third refrigerant pipe 43 along the 1b-th indoor unit connecting pipe 21*b*. The refrigerants moved to the third refrigerant pipe 43 may move to the indoor units 22, 23, and 24 operating in the cooling mode, together with the refrigerants passed through the outdoor heat exchanger 12.

Figure 6:
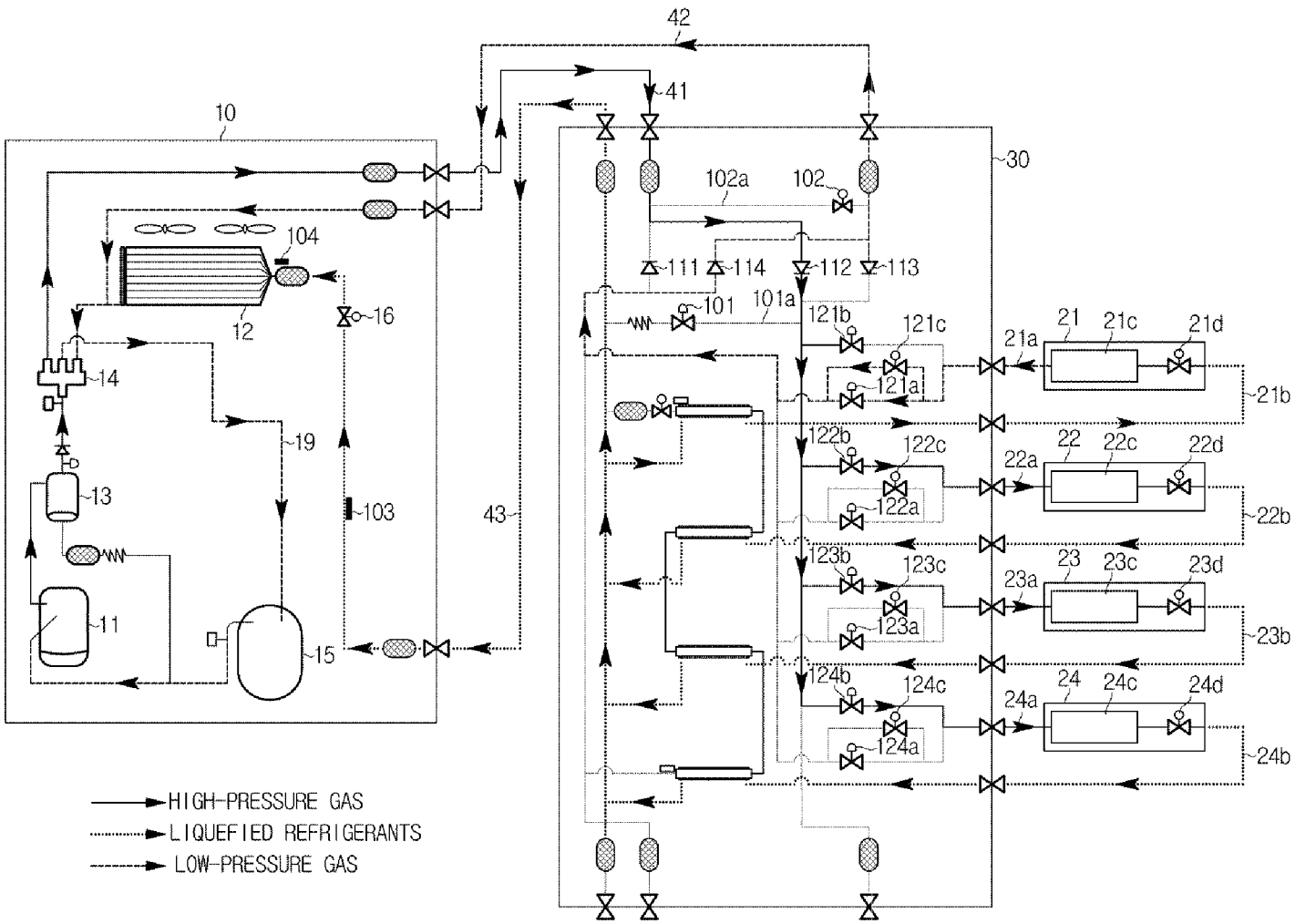
FIG. 6 shows circulation of refrigerants when the plurality of indoor units in the air conditioner shown in FIG. 2 are in a main heating mode.

FIG. 6 shows circulation of refrigerants when the plurality of indoor units in the air conditioner shown in FIG. 2 are in a main heating mode.

Referring to FIG. 6, when the plurality of indoor units 20 operate in the heating mode and the cooling mode, and the indoor units 20 operating in the cooling mode are less than the indoor units 20 operating in the heating mode, that is, when the plurality of indoor units 20 are in the main heating mode, refrigerants in a high-pressure gaseous state may move from the outdoor unit 10 to the mode control unit 30.

The refrigerants in the high-pressure gaseous state passed through the flowpath switching valve 14 may move to the mode control unit 30 along the first refrigerant pipe 41.

The refrigerants moved to the mode control unit 30 may pass through the second check valve 112 and then move to the second, third, and fourth indoor units 22, 23, and 24 operating in the heating mode. More specifically, the refrigerants may pass through the second, third, and fourth heating valves 122*b*, 123*b*, and 124*b* to move to the indoor units 22, 23, and 24 along the 2a-th, 3a-th, and 4a-th indoor unit connecting pipes 22*a*, 23*a*, and 24*a*.

The refrigerants moved to the respective indoor units 22, 23, and 24 may be condensed in the respective indoor heat exchangers 22*c*, 23*c*, and 24*c* to become a liquefied state. The refrigerants in the liquefied state may move to the third refrigerant pipe 43 along the 2b-th, 3b-th, and 4b-th indoor unit connecting pipes 22*b*, 23*b*, and 24*b*.

The refrigerants may enter the outdoor unit 10 along the third refrigerant pipe 43, expand through the outdoor expansion valve 16, and vaporize through the outdoor heat exchanger 12.

A part of the refrigerants moving to the third refrigerant pipe 43 may diverge to the indoor unit 21 operating in the cooling mode. The diverging refrigerants may move to the first indoor unit 21 along the 1b-th indoor unit connecting pipe 21*b*. In the first indoor unit 21, the refrigerants may pass through the first indoor unit expansion valve 21*d* to expand, and then pass through the first indoor heat exchanger 21*c* to vaporize, thereby becoming a low-pressure gaseous state.

The refrigerants in the low-pressure gaseous state may move to the mode control unit 30 along the 1a-th indoor unit connecting pipe 21*a*, and the refrigerants moved to the mode control unit 30 may pass through the first cooling valve 121*a* and the first cooling switching valve 121*c* to then move to the second refrigerant pipe 42 through the fourth check valve 114.

The refrigerants moved along the second refrigerant pipe 42 may enter the flowpath switching valve 14, together with the refrigerants passed through the outdoor heat exchanger 12, and then move to the compressor 11 through the circulating pipe 19 and the accumulator 15.

Figure 8:
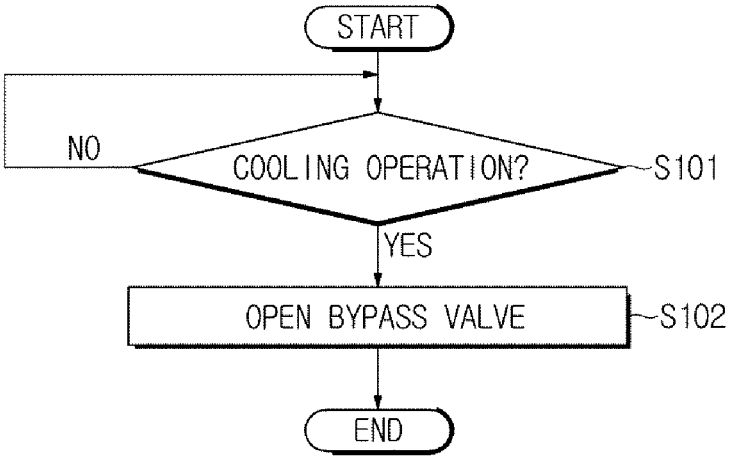
FIG. 8 is a flowchart illustrating a method of controlling the bypass valve shown in FIG. 2.
Figure 9:
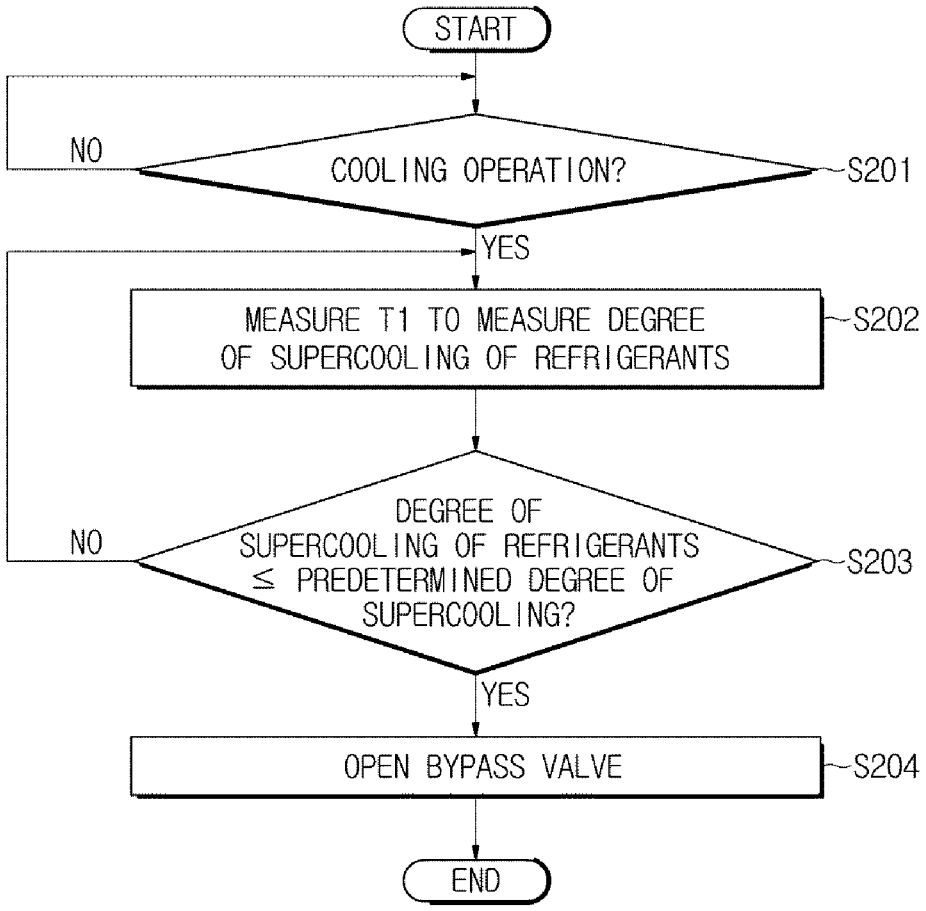
FIG. 9 is a flowchart illustrating a method of controlling the bypass valve shown in FIG. 2, according to another embodiment.
Figure 10:
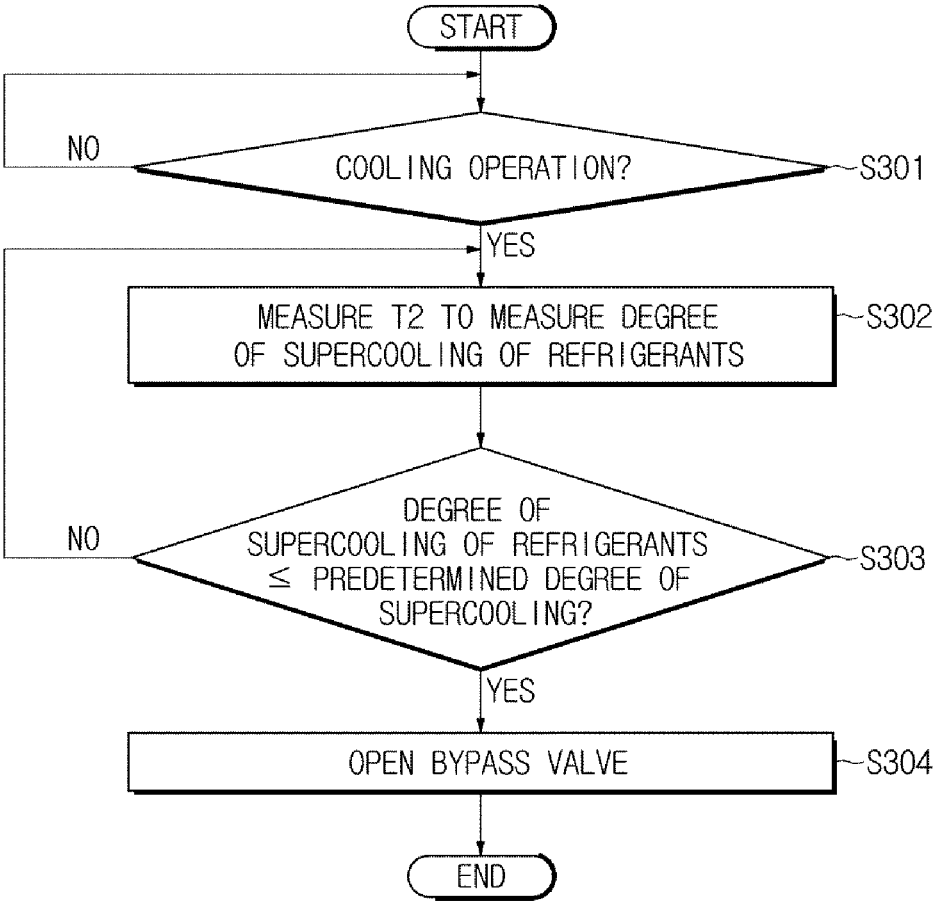
FIG. 10 is a flowchart illustrating a method of controlling the bypass valve shown in FIG. 2, according to another embodiment.

FIG. 7 is a control block diagram showing components for controlling a bypass valve shown in FIG. 2. FIG. 8 is a flowchart illustrating a method of controlling the bypass valve shown in FIG. 2. FIG. 9 is a flowchart illustrating a method of controlling the bypass valve shown in FIG. 2, according to another embodiment. FIG. 10 is a flowchart illustrating a method of controlling the bypass valve shown in FIG. 2, according to another embodiment.

Referring to FIGS. 7 to 10, various methods of controlling the bypass valve 101, according to embodiments of the present disclosure, will be described.

As described above, the air conditioner 1 according to an embodiment may open the bypass valve 101 when all of the plurality of indoor units 20 operate in the cooling mode in order to prevent refrigerants from remaining in a liquefied state in the second refrigerant pipe 42, thereby moving the refrigerants in the second refrigerant pipe 42 to the third refrigerant pipe 43 through the bypass flowpath 101*a*.

Referring to FIG. 8, the air conditioner 1 according to an embodiment of the present disclosure may check a driving mode of the plurality of indoor units 20 to control the bypass valve 101.

More specifically, the controller 105 may determine whether all of the plurality of indoor units 20 operate in the cooling mode, in operation S101.

If the controller 105 determines that all of the plurality of indoor units 20 operate in the cooling mode, the controller 105 may open the bypass valve 101, in operation S102.

If the controller 105 determines that all of the plurality of indoor units 20 do not operate in the cooling mode, the controller 105 may check operation modes of the plurality of indoor units 20 without opening the bypass valve 101.

In contrast, referring to FIGS. 7 and 9, the air conditioner 1 according to an embodiment of the present disclosure may measure temperature T1 of the third refrigerant pipe 43 through the first temperature sensor 103 to control the bypass valve 101.

More specifically, the controller 105 may determine whether all of the plurality of indoor units 20 operate in the cooling mode, in operation S201.

If the controller 105 determines that all of the plurality of indoor units 20 operate in the cooling mode, the controller 105 may measure a degree of supercooling of refrigerants flowing along the third refrigerant pipe 43, based on information about the temperature T1 of the third refrigerant pipe 43 received from the first temperature sensor 103, in operation S202.

If the controller 105 determines that the measured degree of supercooling of the refrigerants is equal to or smaller than a predetermined degree of supercooling, in operation S203, the controller 105 may open the bypass valve 101, in operation S204.

Meanwhile, if the controller 105 determines that the measured degree of supercooling of the refrigerants is greater than the predetermined degree of supercooling, the controller 105 may receive information about temperature T1 of the third refrigerant pipe 43 from the first temperature sensor 103, without opening the bypass valve 101.

The case in which the measured degree of supercooling of the refrigerants is equal to or smaller than the predetermined degree of supercooling may be a state in which loss of refrigerants is great. The predetermined degree of supercooling may be 5 degrees.

In contrast, referring to FIGS. 7 and 10, the air conditioner 1 according to an embodiment of the present disclosure may measure temperature T2 of a portion of the outdoor heat exchanger 12 adjacent to the third refrigerants pipe 43, through the second temperature sensor 104, to control the bypass valve 101.

More specifically, the controller 105 may determine whether all of the plurality of indoor units 20 operate in the cooling mode, in operation S301.

If the controller 105 determines that all of the plurality of indoor units 20 operate in the cooling mode, the controller 105 may measure a degree of supercooling of refrigerants passed through the outdoor heat exchanger 12, based on information about the temperature T2 of the portion of the outdoor heat exchanger 12 adjacent to the third refrigerants pipe 43, received from the second temperature sensor 104, in operation S302.

If the controller 105 determines that the measured degree of supercooling of the refrigerants is equal to or smaller than a predetermined degree of supercooling, in operation S303, the controller 105 may open the bypass valve 101, in operation S304.

Meanwhile, if the controller 105 determines that the measured degree of supercooling of the refrigerants is greater than the predetermined degree of supercooling, the controller 105 may receive information about the temperature T2 of the portion of the outdoor heat exchanger 12 adjacent to the third refrigerants pipe 43, from the second temperature sensor 104, without opening the bypass valve 101.

The case in which the measured degree of supercooling of the refrigerants is equal to or smaller than the predetermined degree of supercooling may be a state in which loss of refrigerants is great. The predetermined degree of supercooling may be 1 degree.

Figure 11:
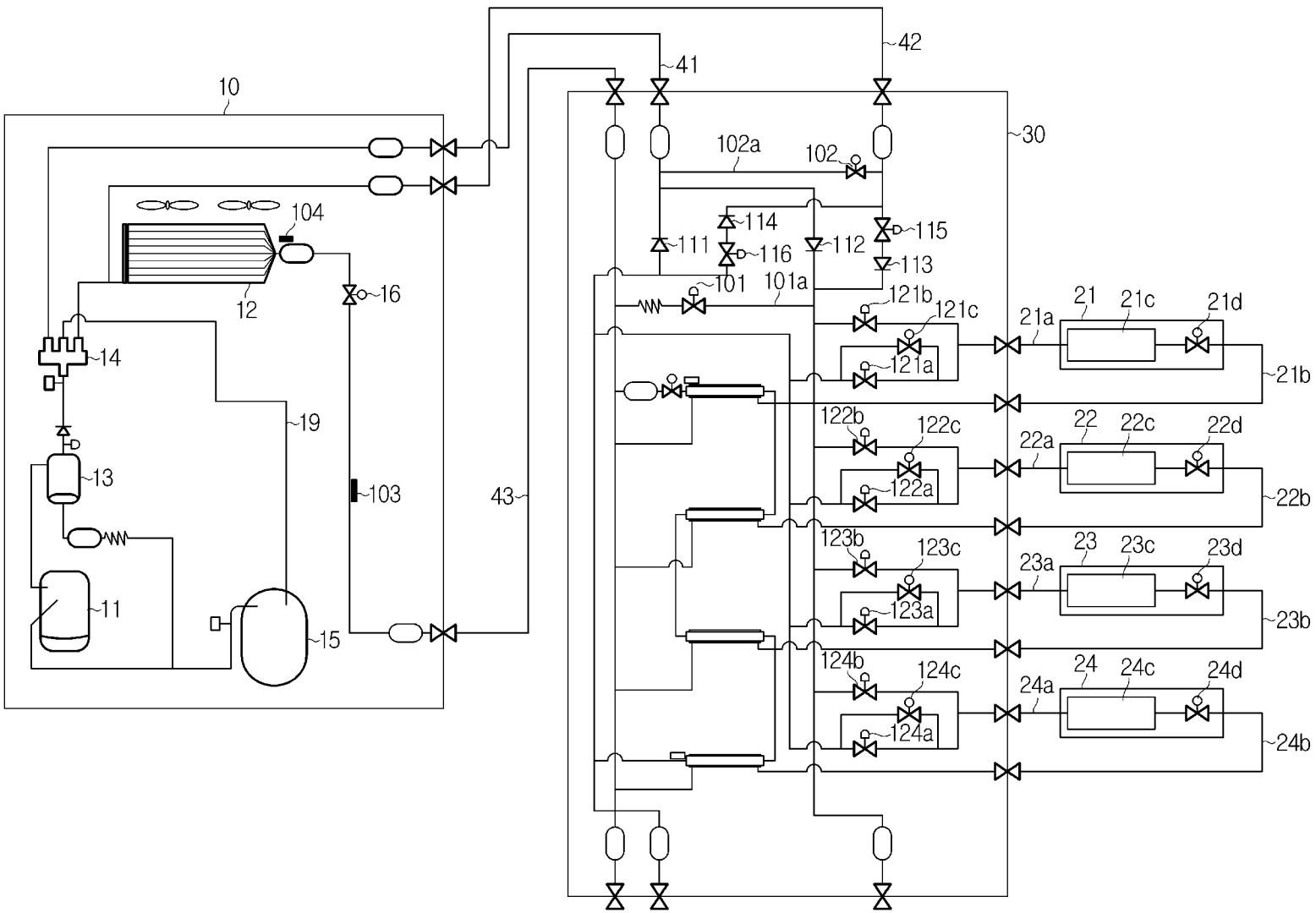
FIG. 11 shows an air conditioner having a mode control unit according to another embodiment of the present disclosure.
Figure 12:
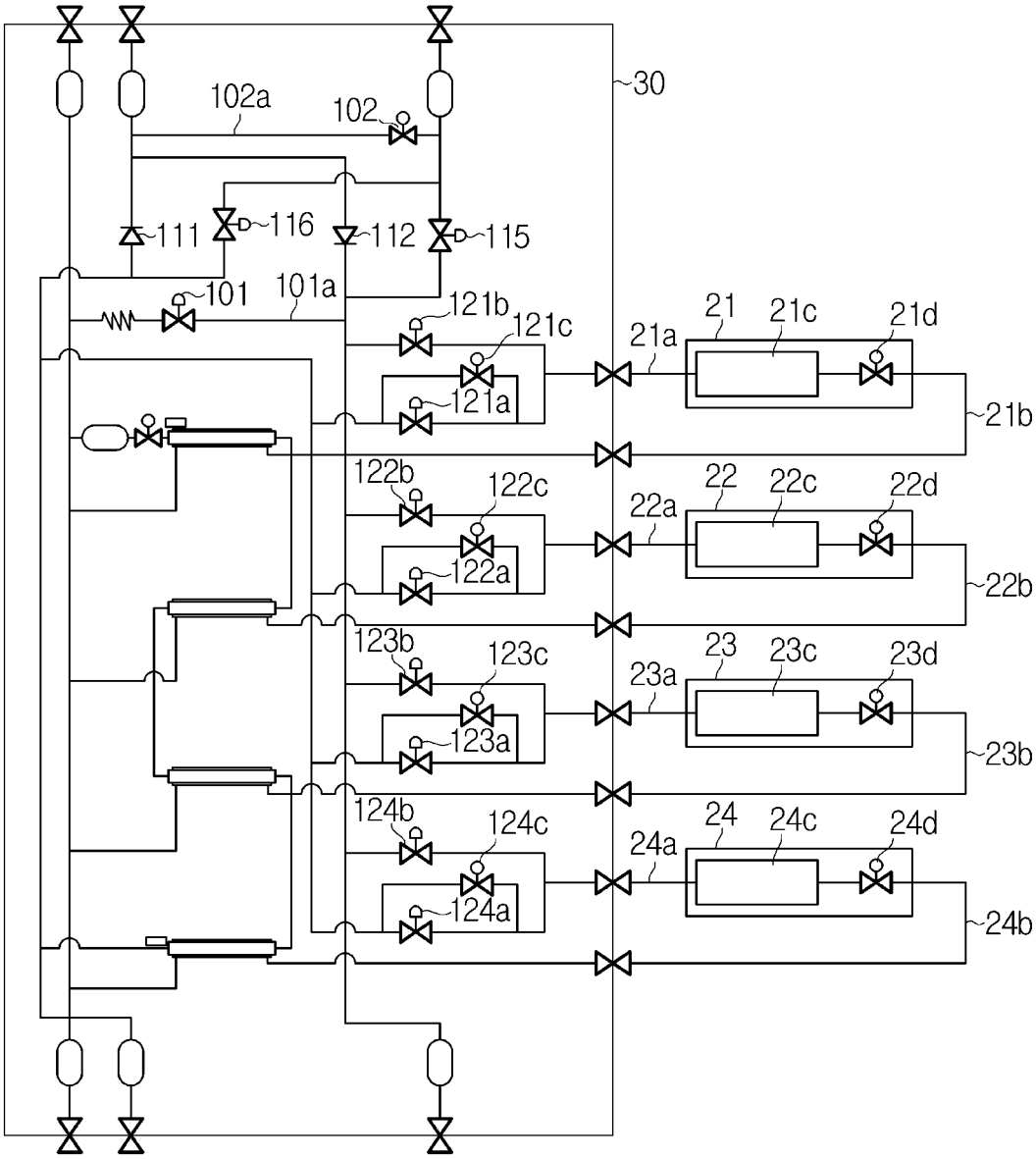
FIG. 12 shows a mode control unit according to another embodiment of the present disclosure.

FIG. 11 shows an air conditioner having a mode control unit according to another embodiment of the present disclosure. FIG. 12 shows a mode control unit according to another embodiment of the present disclosure.

Referring to FIG. 11, the mode control unit according to the other embodiment of the present disclosure may include a main cooling valve 115 for arbitrarily preventing refrigerants from moving forward through the third check valve 113, and a main heating valve 116 for arbitrarily preventing refrigerants from moving forward through the fourth check valve 114, in addition to the first check valve 111, the second check valve 112, the third check valve 113, and the fourth check valve 114, as shown in FIG. 2.

The main cooling valve 115 may open when the plurality of indoor units 20 operate in the main cooling mode. The main cooling valve 115 may be disposed on the refrigerant flowpath between the heating valves 121*b*, 122*b*, 123*b*, and 124*b* and the second refrigerant pipe 42.

The main heating valve 116 may open when the plurality of indoor units 20 operate in the main heating mode. The main heating valve 116 may be disposed on the refrigerant flowpath between the cooling valves 121*a*, 122*a*, 123*a*, and 124*a* and the second refrigerant pipe 42.

Referring to FIG. 12, the main cooling valve 115 may be provided, and the third check valve 113 may be omitted. Likewise, the main heating valve 116 may be provided, and the fourth check valve 114 may be omitted.

Figure 13:
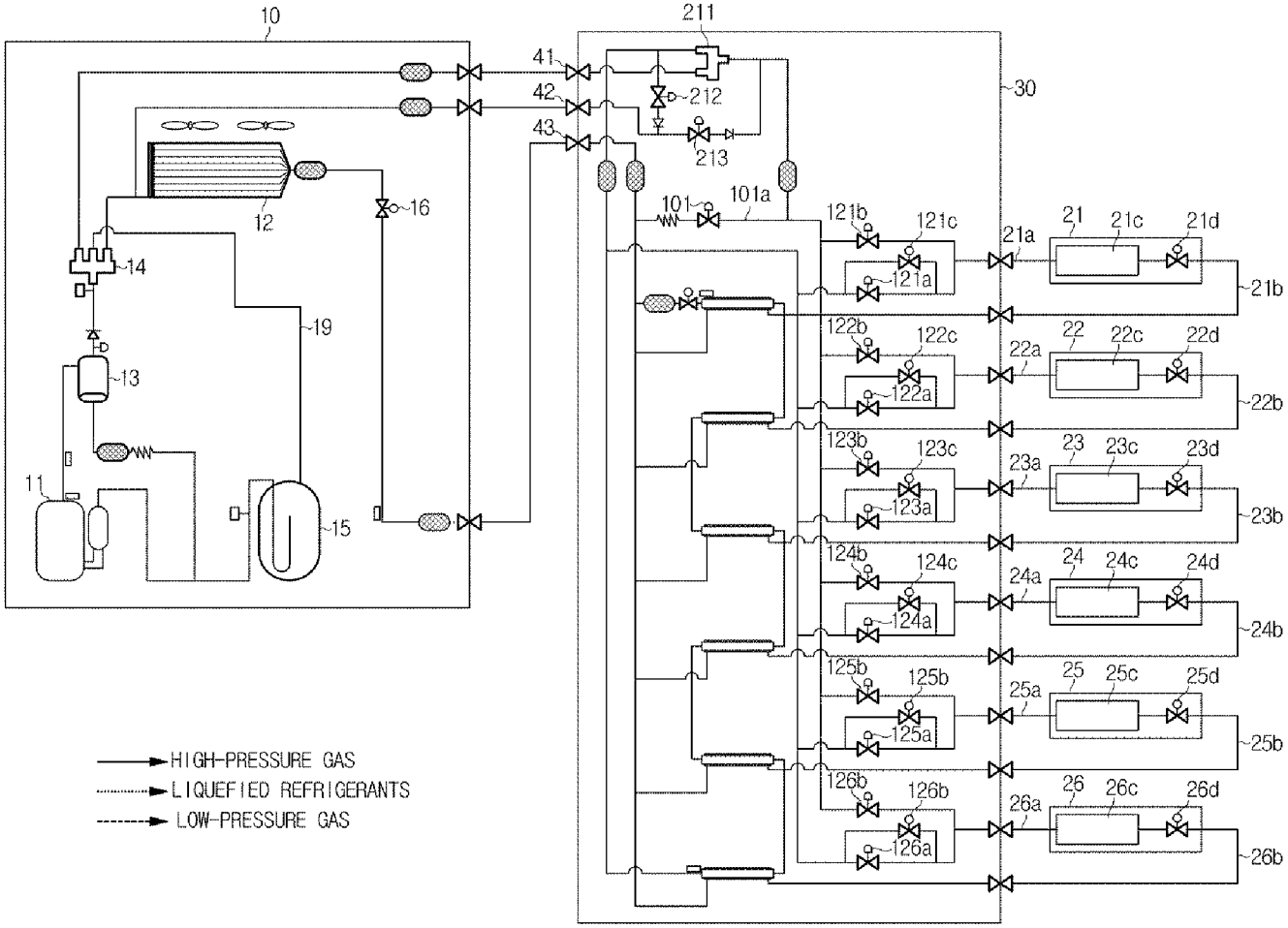
FIG. 13 shows a cooling cycle of an air conditioner having a mode control unit according to another embodiment of the present disclosure.
Figure 14:
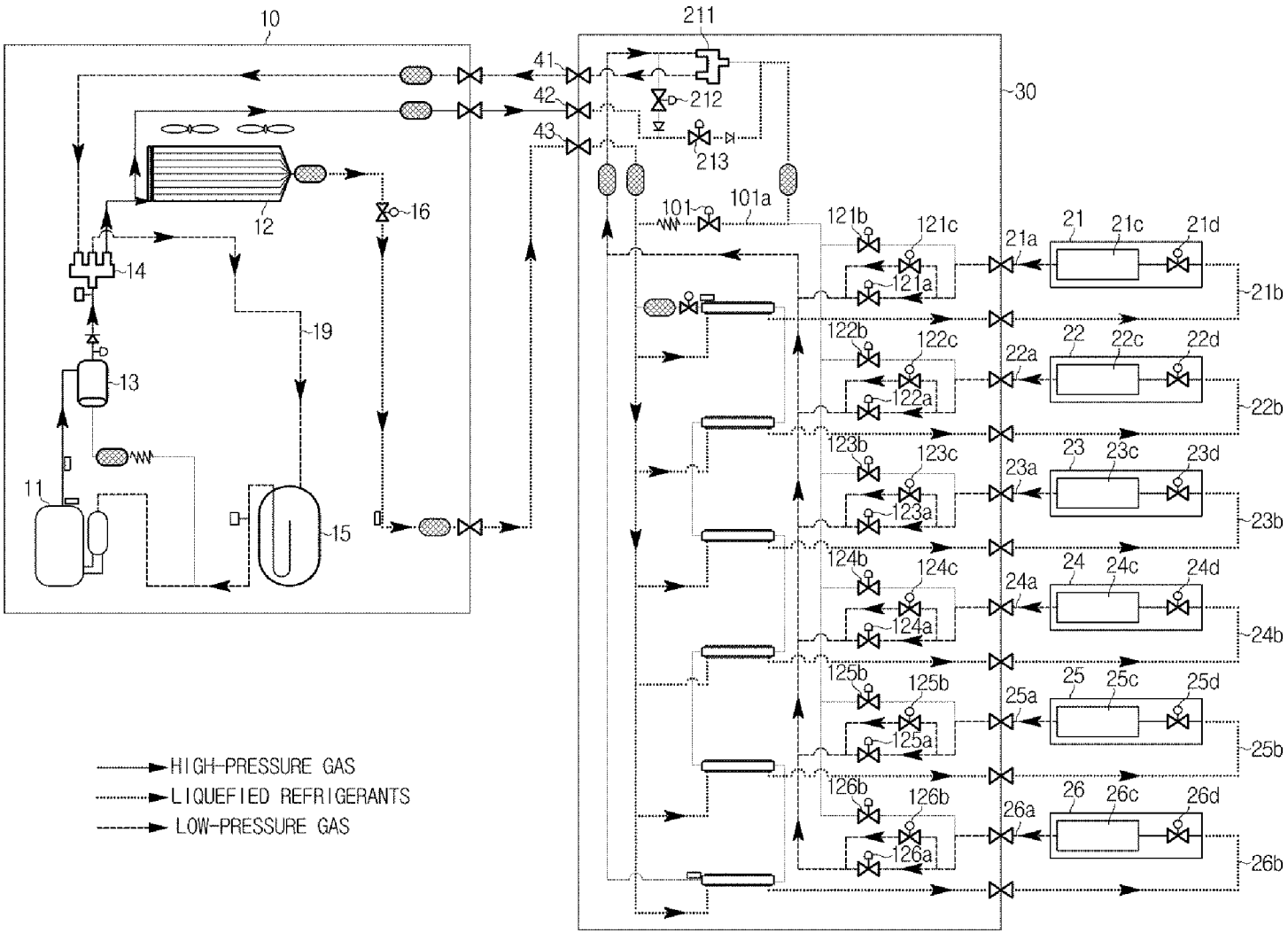
FIG. 14 shows circulation of refrigerants when all of a plurality of indoor units are in a cooling mode in the air conditioner shown in FIG. 13.
Figure 15:
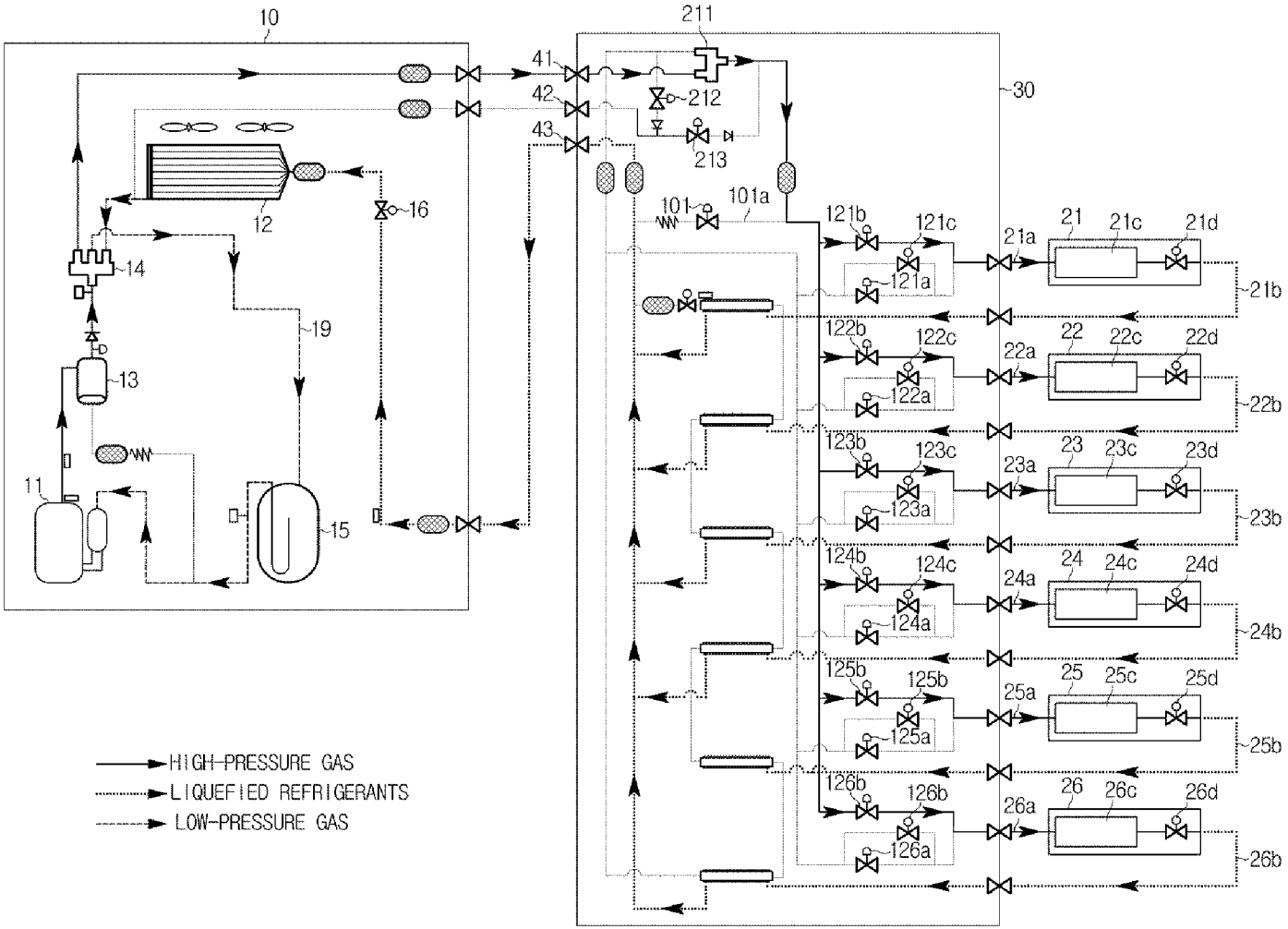
FIG. 15 shows circulation of refrigerants when all of the plurality of indoor units are in a heating mode in the air conditioner shown in FIG. 13.
Figure 16:
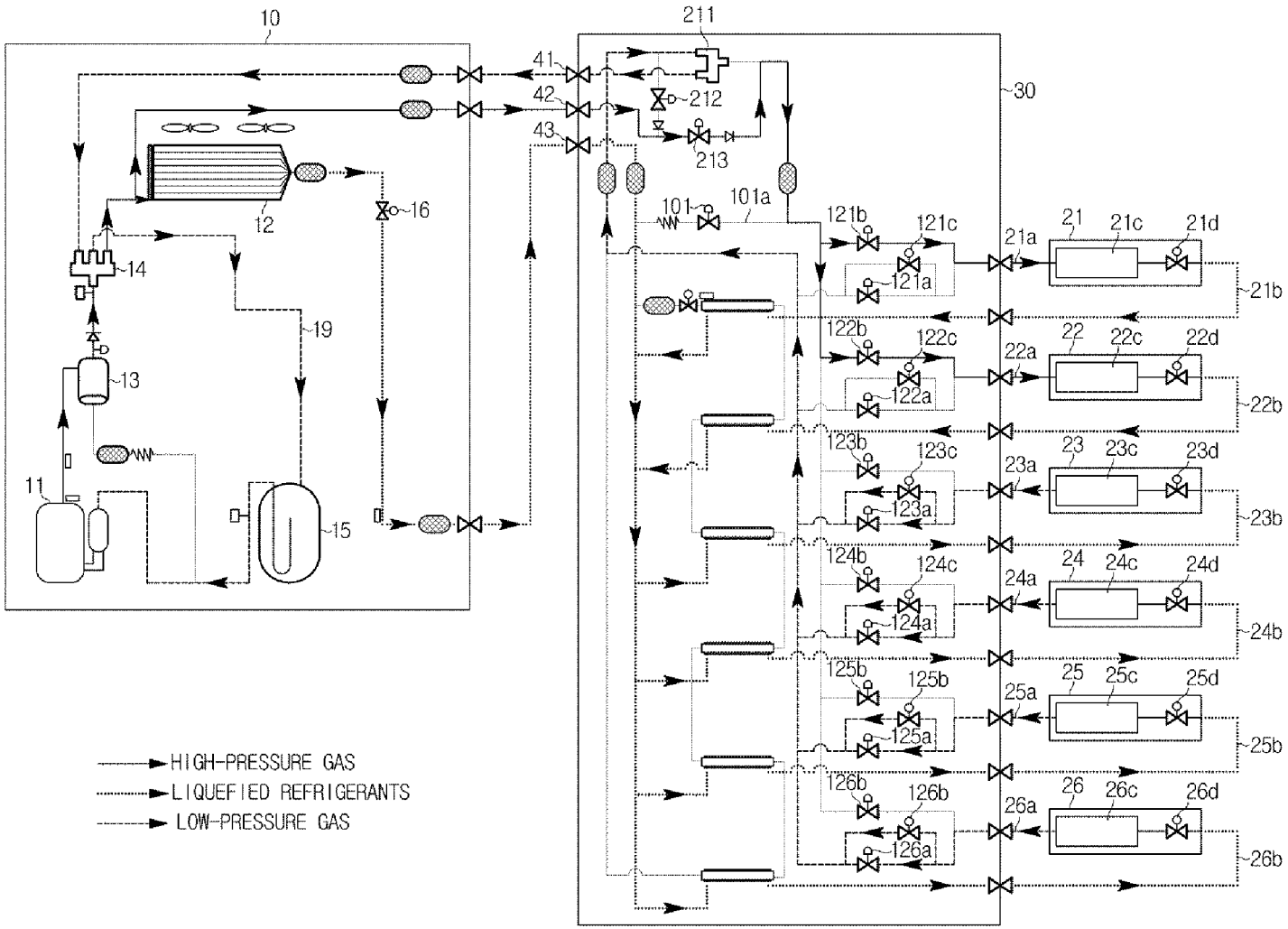
FIG. 16 shows circulation of refrigerants when all of the plurality of indoor units are in a main cooling mode in the air conditioner shown in FIG. 13.
Figure 17:
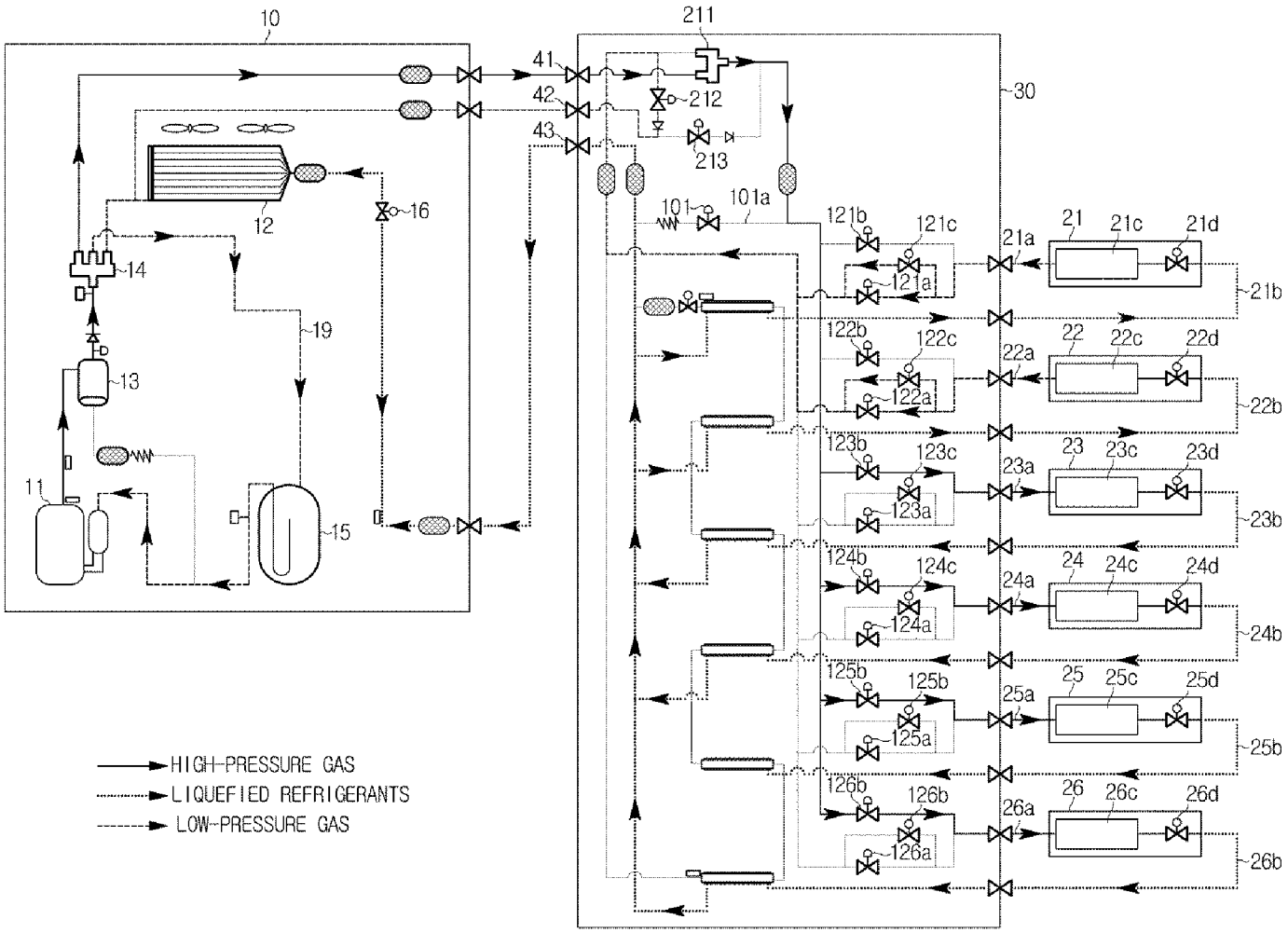
FIG. 17 shows circulation of refrigerants when all of the plurality of indoor units are in a main heating mode in the air conditioner shown in FIG. 13.

FIG. 13 shows a cooling cycle of an air conditioner having a mode control unit according to another embodiment of the present disclosure. FIG. 14 shows circulation of refrigerants when all of a plurality of indoor units are in a cooling mode in the air conditioner shown in FIG. 13. FIG. 15 shows circulation of refrigerants when all of the plurality of indoor units are in a heating mode in the air conditioner shown in FIG. 13. FIG. 16 shows circulation of refrigerants when all of the plurality of indoor units are in a main cooling mode in the air conditioner shown in FIG. 13. FIG. 17 shows circulation of refrigerants when all of the plurality of indoor units are in a main heating mode in the air conditioner shown in FIG. 13.

Referring to FIG. 13, an air conditioner according to an embodiment of the present disclosure will be described. The same components as those described in the above-described embodiments will be assigned the same reference numerals as those assigned in the above-described embodiments, and detailed descriptions thereof will be omitted.

The mode control unit 30 may include a mode conversion valve 211, a first valve 212, and a second valve 213, instead of the first to fourth check valves 111 to 114 shown in FIG. 2.

Referring to FIG. 14, when all of the plurality of indoor units 20 operate in the cooling mode, refrigerants in a high-pressure gaseous state passed through the flowpath switching valve 14 may move to the outdoor heat exchanger 12.

The refrigerants may be condensed by the outdoor heat exchanger 12 to become a liquefied state, and the refrigerants in the liquefied state may move to the mode control unit 30 along the third refrigerant pipe 43. The refrigerants moved to the mode control unit 30 may move to the respective indoor units 21, 22, 23, 24, 25, and 26 along the 1b-th to 6b-th indoor unit connecting pipes 21*b*, 22*b*, 23*b*, 24*b*, 25*b*, and 26*b*. In the respective indoor units 21, 22, 23, 24, 25, and 26, the refrigerants may pass through the indoor expansion valves 21*d*, 22*d*, 23*d*, 24*d*, 25*d*, and 26*d* to expand, and pass through the indoor heat exchangers 21*c*, 22*c*, 23*c*, 24*c*, 25*c*, and 26*c* to vaporize.

The vaporized refrigerants may move to the mode control unit 30 along the 1a-th to 6a-th indoor unit connecting pipes 21*a*, 22*a*, 23*a*, 24*a*, 25*a*, and 26*a*, pass through the respective cooling valves 121*a*, 122*a*, 123*a*, 124*a*, 125*a*, and 126*a* and the respective cooling switching valves 121*c*, 122*c*, 123*c*, 124*c*, 125*c*, and 126*c*, and then move to the mode switching valve 211.

The refrigerants moved to the mode switching valve 211 may move to the flowpath switching valve 14 along the first refrigerant pipe 41, and then pass through the circulating pipe 19 and the accumulator 15 to move to the compressor 11.

Meanwhile, a part of the refrigerants in the high-pressure gaseous state moving to the outdoor heat exchanger 12 may diverge to the second refrigerant pipe 42 to move to the mode control unit 30. The refrigerants in the high-pressure gaseous state moved to the mode control unit 30 may be liquefied by temperature of inside space where the mode control unit 30 is disposed, when the bypass valve 101 is closed so that the refrigerants remain in the mode control unit 30. The liquefied refrigerants may not circulate in the refrigerant pipe, and accordingly, the air conditioner 1 may cause loss of the refrigerants.

In order to prevent the problem, the air conditioner 1 according to an embodiment of the present disclosure may cause the bypass valve 101 to open the bypass flowpath 101*a*, thereby guiding the refrigerants in the liquefied state remaining in the mode control unit 30 to the third refrigerant pipe 43 along the bypass flowpath 101*a*. The refrigerants entered the third refrigerant pipe 43 may move to the plurality of indoor units 20, together with refrigerants entered through the outdoor heat exchanger 12.

According to the configuration, the air conditioner 1 according to an embodiment of the present disclosure may guide the refrigerants remaining in the second refrigerant pipe 42 for a heat recovery cycle to the third refrigerant pipe 43 through the bypass flowpath 101*a*, thereby preventing loss of the refrigerants.

Referring to FIG. 15, when all of the plurality of indoor units 20 operate in the heating mode, the refrigerants in the high-pressure gaseous state passed through the flowpath switching valve 14 may move to the mode control unit 30 through the first refrigerant pipe 41.

The refrigerants moved to the mode control unit 30 may pass through the mode switching valve 211 to move to the respective indoor units 21, 22, 23, 24, 25, and 26.

More specifically, the refrigerants may pass through the respective heating valves 121*b*, 122*b*, 123*b*, 124*b*, 125*b*, and 126*b*, and then move to the respective indoor units 21, 22, 23, 24, 25, and 26 along the 1a-th to 6a-th indoor unit connecting pipes 21*a*, 22*a*, 23*a*, 24*a*, 25*a*, and 26*a*.

In the respective indoor units 21, 22, 23, 24, 25, and 26, the refrigerants may be condensed to become a liquefied state, and the refrigerants in the liquefied state may move to the mode control unit 30 along the 1b-th to 6b-th indoor unit connecting pipes 21*b*, 22*b*, 23*b*, 24*b*, 25*b*, and 26*b*.

Thereafter, the refrigerants may move to the outdoor unit 10 along the third refrigerant pipe 43.

The refrigerants moved to the outdoor unit 10 may expand in the outdoor expansion valve 16, and then vaporize in the outdoor heat exchanger 12. The vaporized refrigerants may move to the compressor 11 through the flowpath switching valve 14, the circulating pipe 19, and the accumulator 15.

Referring to FIG. 16, when the plurality of indoor units 20 operate in the heating mode and the cooling mode, and the indoor units 20 operating in the cooling mode are more than the indoor units 20 operating in the heating mode, that is, when the plurality of indoor units 20 are in the main cooling mode, refrigerants in a high-pressure gaseous state and liquefied refrigerants may move from the outdoor unit 10 to the mode control unit 30.

A part of the refrigerants in the high-pressure gaseous state passed through the flowpath switching valve 14 may pass through the outdoor heat exchanger 12 to be condensed, and the remaining part of the refrigerants may move to the mode control unit 30 along the second refrigerant pipe 42.

The refrigerants passed through the outdoor heat exchanger 12 may move to the mode control unit 30 along the third refrigerant pipe 43, and then move to the respective indoor units 23, 24, 25, and 26 operating in the cooling mode along the 3b-th to 6b-th indoor unit connecting pipes 23*b*, 24*b*, 25*b*, and 26*b*.

In the respective indoor units 23, 24, 25, and 26 operating in the cooling mode, the refrigerants may pass through the respective indoor expansion valves 23*d*, 24*d*, 25*d*, and 26*d* to expand, and pass through the respective indoor heat exchangers 23*c*, 24*c*, 25*c*, and 26*c* to vaporize.

The vaporized refrigerants in the low-pressure gaseous state may move to the mode control unit 30 along the 3a-th to 6a-th indoor unit connecting pipes 23*a*, 24*a*, 25*a*, and 26*a*, pass through the respective cooling valves 123*a*, 124*a*, 125*a*, and 126*a* and the respective cooling switching valves 123*c*, 124*c*, 125*c*, and 126*c*, and then move to the mode switching valve 211.

The refrigerants passed through the mode conversion valve 211 may move to the outdoor unit 10 along the first cooling pipe 41. The refrigerants moved to the indoor unit 10 may pass through the flowpath switching valve 14, the circulating pipe 19, and the accumulator 15 to move to the compressor 11.

Meanwhile, the refrigerants in the high-pressure gaseous state diverging to the second refrigerant pipe 42 may move to the mode control unit 30 along the second refrigerant pipe 42, and then pass through the first and second heating valves 121*b* and 122*b* via the second valve 213 to move to the 1a-th and 2a-th indoor connecting pipes 21*a* and 22*a*.

The refrigerants moved to the respective indoor units 21 and 22 operating in the heating mode along the 1a-th and 2a-th indoor unit connecting pipes 21*a* and 22*a* may be condensed in the respective indoor heat exchangers 21*c* and 22*c* to become a liquefied state, and then return to the mode control unit 30 along the 1b-th and 2b-th indoor unit connecting pipes 21*b* and 22*b*.

The refrigerants returned to the mode control unit 30 may enter the third refrigerant pipe 43 through which the refrigerants passed the outdoor heat exchanger 12 move.

Referring to FIG. 17, when the plurality of indoor units 20 operate in the heating mode and the cooling mode, and the indoor units 20 operating in the cooling mode are less than the indoor units 20 operating in the heating mode, that is, when the plurality of indoor units 20 are in the main heating mode, refrigerants in a high-pressure gaseous state may move from the outdoor unit 10 to the mode control unit 30.

The refrigerants in the high-pressure gaseous state passed through the flowpath switching valve 14 may move to the mode control unit 30 along the first refrigerants pipe 41.

The refrigerants moved to the mode control unit 30 may pass through the mode switching valve 211, and move to the respective indoor units 23, 24, 25, and 26 operating in the heating mode along the 3a-th to 6a-th indoor unit connecting pipes 23*a*, 24*a*, 25*a*, and 26*a* through the third to sixth heating valves 123*b*, 124*b*, 125*b*, and 126*b*.

The refrigerants moved to the respective indoor units 23, 24, 25, and 26 operating in the heating mode may be condensed in the respective indoor heat exchangers 23*c*, 24*c*, 25*c*, and 26*c* to become a liquefied state. The refrigerants in the liquefied state may return to the mode control unit 30 along the 3b-th to 6b-th indoor unit connecting pipes 23*b*, 24*b*, 25*b*, and 26*b*.

The refrigerants returned to the mode control unit 30 may enter the outdoor unit 10 along the third refrigerant pipe 43.

The refrigerants entered the outdoor unit 10 may pass through the outdoor expansion valve 16 to expand, and then pass through the outdoor heat exchanger 12 to vaporize.

The vaporized refrigerants may enter the flowpath switching valve 14 in a low-pressure gaseous state, and pass through the circulating pipe 19 and the accumulator 15 to move to the compressor 11.

Meanwhile, a part of the refrigerants in the liquefied state of the third refrigerant pipe 43 may diverge to move to the indoor units 21 and 22 operating in the cooling mode. The diverging refrigerants may move to the first and second indoor units 21 and 22 along the 1b-th and 2b-th indoor unit connecting pipes 21*b* and 22*b*.

The refrigerants moved to the first and second indoor units 21 and 22 may expand in the first and second indoor expansion valves 21*d* and 22*d*, and then vaporize in the first and second indoor heat exchanger 21*c* and 22*c*.

The vaporized refrigerants may move to the first valve 212 in a low-pressure gaseous state through the first and second cooling valves 121*a* and 122*a* and the first and second cooling switching valves 121*c* and 122*c*. The refrigerants in the low-pressure gaseous state passed through the first valve 212 may enter the outdoor unit 10 through the second refrigerant pipe 42 to move to the flowpath switching valve 14, together with the refrigerants passed through the outdoor heat exchanger 12.

The refrigerants moved to the flowpath switching valve 14 may pass through the circulating pipe 19 and the accumulator 15 to move to the compressor 11.

According to a technical concept of the present disclosure, the air conditioner can reduce the size of the outdoor unit, since components for the heat recovery cycle are disposed in the mode control unit.

According to another technical concept of the present disclosure, the air conditioner can perform both the heat pump cycle and the heat recovery cycle with a relatively simple configuration, by providing a gas pipe diverging between the 4-way valve of the outdoor unit and the outdoor heat exchanger.

According to another technical concept of the present disclosure, the air conditioner can reduce loss of refrigerants, by providing the bypass valve for bypassing high-pressure refrigerants of the gas pipe diverging between the 4-way valve of the outdoor unit and the outdoor heat exchanger to a liquid pipe, when the high-pressure refrigerants are condensed and remain in indoor space where the mode control unit is disposed, during cooling operation.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. An air conditioner comprising:

an outdoor unit having a compressor, an outdoor heat exchanger, and a flowpath switching valve disposed on a refrigerant flowpath between the compressor and the outdoor heat exchanger;

a plurality of indoor units configured to operate in a cooling mode or in a heating mode;

a mode controller configured to selectively guide refrigerant received from the outdoor unit to the plurality of indoor units through one or more of:

a first refrigerant pipe extending from the flowpath switching valve to the mode controller;

a second refrigerant pipe extending from the flowpath switching valve and diverging to the outdoor heat exchanger and the mode controller; and a third refrigerant pipe extending from the outdoor heat exchanger to the mode controller, wherein the mode controller comprises:

a bypass flowpath connecting the second refrigerant pipe to the third refrigerant pipe; and a bypass valve configured to open or close the bypath flowpath.

2. The air conditioner according to claim 1, wherein while all of the plurality of indoor units operate in the cooling mode, the bypass valve opens the bypass flowpath so that the second refrigerant pipe communicates with the third refrigerant pipe.

3. The air conditioner according to claim 2, wherein the mode controller further comprises a controller configured to control the bypass valve, and the controller controls the bypass valve to open the bypass flowpath, when a degree of supercooling of refrigerant flowing through the third refrigerant pipe is smaller than or equal to a predetermined degree of supercooling based on a discharge pressure of the compressor.

4. The air conditioner according to claim 3, wherein the outdoor unit further comprises a temperature sensor disposed at a portion of the third refrigerant pipe that is disposed in an inside of the outdoor unit.

5. The air conditioner according to claim 2, wherein the mode controller further comprises a controller configured to control the bypass valve, and wherein the controller controls the bypass valve to open the bypass flowpath, when a degree of supercooling of refrigerant passed through the outdoor heat exchanger is smaller than or equal to a predetermined degree of supercooling based on a discharge pressure of the compressor.

6. The air conditioner according to claim 5, wherein the outdoor unit further comprises a temperature sensor disposed at a portion of the outdoor heat exchanger adjacent to the third refrigerant pipe.

7. The air conditioner according to claim 1, wherein the mode controller is disposed in an indoor space.

8. The air conditioner according to claim 1, wherein the mode controller comprises:

a heating valve configured to open or close the refrigerant flowpath to transfer refrigerant to indoor units operating in the heating mode among the plurality of indoor units;

a cooling valve configured to open or close the refrigerant flowpath to receive refrigerant from indoor units operating in the cooling mode among the plurality of indoor units;

a main cooling valve disposed on the refrigerant flowpath between the heating valve and the second refrigerant pipe; and a main heating valve disposed on the refrigerant flowpath between the cooling valve and the second refrigerant pipe.

9. The air conditioner according to claim 8, wherein when indoor units among the plurality of indoor units operate in the heating mode, and a number of indoor units operating in the cooling mode among the plurality of indoor units are more than a number of the indoor units operating in the heating mode, the main cooling valve opens the refrigerant flowpath so that the heating valve communicates with the second refrigerant pipe.

10. The air conditioner according to claim 8, wherein when indoor units among the plurality of indoor units operate in the cooling mode, and a number of indoor units operating in the heating mode among the plurality of indoor units are more than a number of the indoor units operating in the cooling mode, the main heating valve opens the refrigerant flowpath so that the cooling valve communicates with the second refrigerant pipe.

11. The air conditioner according to claim 1, wherein the outdoor unit comprises:

an accumulator connected to the compressor; and a circulating pipe connecting the flowpath switching valve, the accumulator, and the compressor, sequentially.

12. The air conditioner according to claim 1, wherein the mode controller comprises:

a switching flowpath connecting the first refrigerant pipe to the second refrigerant pipe; and a switching valve configured to open or close the switching flowpath.

13. The air conditioner according to claim 12, wherein the switching valve opens or closes the switching flowpath to adjust a difference between pressure of refrigerant flowing through the first refrigerant pipe and pressure of refrigerant flowing through the second refrigerant pipe.

14. The air conditioner according to claim 1, wherein the flowpath switching valve is a 4-way valve.

15. An air conditioner comprising:

an outdoor unit having a compressor, an outdoor heat exchanger, and a flowpath switching valve disposed on a refrigerant flowpath between the compressor and the outdoor heat exchanger;

a plurality of indoor units configured to operate in a cooling mode or in a heating mode;

a mode controller configured to selectively guide refrigerant received from the outdoor unit to the plurality of indoor units through one or more of:

a first refrigerant pipe extending from the flowpath switching valve to the mode controller;

a second refrigerant pipe extending from the flowpath switching valve and diverging to the outdoor heat exchanger and the mode controller; and a third refrigerant pipe extending from the outdoor heat exchanger to the mode controller, wherein the mode controller has a bypass flowpath that guides refrigerant entering the second refrigerant pipe to the third refrigerant pipe while the plurality of indoor units operate in the cooling mode.

16. The air conditioner according to claim 15, wherein the outdoor unit further comprises a temperature sensor disposed at a portion of the third refrigerant pipe disposed in an inside of the outdoor unit, and wherein the mode controller guides refrigerant entered the second refrigerant pipe to the third refrigerant pipe, when a degree of supercooling of refrigerant flowing through the third refrigerant pipe is smaller than or equal to a predetermined degree of supercooling based on temperature measured by the temperature sensor.

17. The air conditioner according to claim 15, wherein the outdoor unit further comprises a temperature sensor disposed at a portion of the outdoor heat exchanger adjacent to the third refrigerant pipe, and wherein the mode controller guides refrigerant entered the second refrigerant pipe to the third refrigerant pipe, when a degree of supercooling of refrigerant passed through the outdoor heat exchanger is smaller than or equal to a predetermined degree of supercooling based on temperature measured by the temperature sensor.

18. The air conditioner according to claim 15, wherein the mode controller is disposed in an indoor space.

19. An air conditioner comprising:

an outdoor unit having a compressor, an outdoor heat exchanger, and a flowpath switching valve disposed on a refrigerant flowpath between the compressor and the outdoor heat exchanger;

a plurality of indoor units configured to operate in a cooling mode or in a heating mode;

a mode controller configured to selectively guide refrigerant received from the outdoor unit to the plurality of indoor units through one or more of:

a first refrigerant pipe extending from the flowpath switching valve to the mode controller;

a second refrigerant pipe extending from the flowpath switching valve and diverging to the outdoor heat exchanger and the mode controller; and a third refrigerant pipe extending from the outdoor heat exchanger to the mode controller, wherein the mode controller comprises:

a first check valve configured to enable the first refrigerant pipe to communicate with the plurality of indoor units, while the plurality of indoor units operate in the cooling mode;

a second check valve configured to enable the first refrigerant pipe to communicate with the plurality of indoor units, while the plurality of indoor units operate in the heating mode;

a third check valve configured to enable the second refrigerant pipe to communicate with indoor units operating in the heating mode among the plurality of indoor units, while a number of indoor units operating in the cooling mode among the plurality of indoor units are more than a number of the indoor units operating in the heating mode; and a fourth check valve configured to enable the second refrigerant pipe to communicate with indoor units operating in the cooling mode among the plurality of indoor units, while the number of indoor units operating in the heating mode among the plurality of indoor units are more than the number of the indoor units operating in the cooling mode.

* * * * *